US007156387B2

(12) United States Patent
Hidaka et al.

(10) Patent No.: US 7,156,387 B2
(45) Date of Patent: Jan. 2, 2007

(54) SHEET FEEDING APPARATUS, SHEET CONVEYING APPARATUS, AND IMAGE READING APPARTUS

(75) Inventors: Makoto Hidaka, Kohto-ku (JP); Kazuya Tsutsui, Shinagawa-ku (JP); Tooru Horio, Owariasahi (JP)

(73) Assignee: Ricoh Company, Ltd., Tokyo (JP)

( * ) Notice: Subject to any disclaimer, the term of this patent is extended or adjusted under 35 U.S.C. 154(b) by 36 days.

(21) Appl. No.: 10/647,309

(22) Filed: Aug. 26, 2003

(65) Prior Publication Data

US 2004/0094887 A1 May 20, 2004

(30) Foreign Application Priority Data

Aug. 27, 2002 (JP) ..... 2002-246885

(51) Int. Cl.
*B65H 5/00* (2006.01)

(52) U.S. Cl. ..... 271/10.02; 271/10.03; 271/110

(58) Field of Classification Search ..... 271/10.02, 271/10.03, 110
See application file for complete search history.

(56) References Cited

U.S. PATENT DOCUMENTS 4,485,949 A * 12/1984 Gebhart et al. ..... 226/2
5,072,924 A * 12/1991 Sugiyama ..... 271/110
5,131,641 A 7/1992 Hidaka
5,197,726 A * 3/1993 Nogami ..... 271/110
5,298,958 A * 3/1994 Takahashi ..... 399/43
5,333,211 A 7/1994 Kanda et al.
5,419,547 A * 5/1995 Jeong ..... 271/263
5,597,154 A * 1/1997 Yamashita ..... 271/10.05
5,673,340 A 9/1997 Kanda
5,678,135 A 10/1997 Fukui et al.
5,692,741 A * 12/1997 Nakamura et al. ..... 271/10.03
6,042,111 A * 3/2000 Rivers et al. ..... 271/270
6,098,977 A * 8/2000 Sato et al. ..... 271/186
6,298,778 B1 * 10/2001 Onodera et al. ..... 101/232
6,305,681 B1 10/2001 Watanabe et al.
6,729,613 B1 * 5/2004 Marra et al. ..... 271/10.02

FOREIGN PATENT DOCUMENTS

JP 62-88748 * 4/1987

(Continued)

OTHER PUBLICATIONS

U.S. Appl. No. 10/647,309, filed Aug. 26, 2003, Hidaka et al.

(Continued)

*Primary Examiner*—Patrick Mackey
*Assistant Examiner*—Thomas Morrison
(74) *Attorney, Agent, or Firm*—Oblon, Spivak, McClelland, Maier & Neustadt, P.C.

(57) ABSTRACT

A sheet feeding apparatus includes a sheet feeding device that picks up sheets from stacked sheets and feeds the sheets one by one, a drive device that drives the sheet feeding device, first and second detecting devices that detect the fed sheet, and a control device that feeds the sheet while setting a drive amount of the drive device. The control device calculates a first drive amount of the drive device during a first interval from when the first detecting device detects the sheet to when the second detecting device detects the sheet based on information detected by the first and second detecting devices, and the control device sets a second drive amount of the drive device during a second interval from when the second detecting device detects the sheet to when the drive device is stopped based on the calculated first drive amount.

23 Claims, 20 Drawing Sheets

FOREIGN PATENT DOCUMENTS

| | | | |
|---|---|---|---|
| JP | 1-162654 | * | 6/1989 |
| JP | 2-100941 | * | 4/1990 |
| JP | 2-209344 | * | 8/1990 |
| JP | 11-309934 | * | 11/1999 |
| JP | 2000-219365 | | 8/2000 |
| JP | 2000-321828 | * | 11/2000 |

OTHER PUBLICATIONS

U.S. Appl. No. 10/781,917, filed Feb. 20, 2004, Horio.
U.S. Appl. No. 08/236,024
U.S. Appl. No. 09/997,304 filed Nov. 30, 2001, Tamura et al.
U.S. Appl. No. 10/015,634, filed Dec. 17, 2001, Tamura et al.
U.S. Appl. No. 10/109,992, filed Apr. 01, 2002, Nagasako et al.
U.S. Appl. No. 10/172,910, filed Jun. 18, 2002, Tamura et al.
U.S. Appl. No. 10/647,309, filed Aug. 26, 2003, Hidaka et al.

* cited by examiner

SHEET FEEDING APPARATUS, SHEET CONVEYING APPARATUS, AND IMAGE READING APPARTUS

CROSS-REFERENCE TO RELATED APPLICATIONS

The present application claims priority to Japanese Patent Application No. 2002-246885 filed in the Japanese Patent Office on Aug. 27, 2002, the disclosure of which is incorporated herein by reference.

BACKGROUND OF THE INVENTION

1. Field of the Invention

The present invention relates to a sheet feeding apparatus, a sheet conveying apparatus, and an image reading apparatus for use in an image forming apparatus, such as, a copying machine, a printer, a facsimile machine, or other similar image forming apparatus, that feed and convey a sheet to an image reading position.

2. Discussion of the Background

An image forming apparatus, such as, a copying machine, a printer, a facsimile machine, or other similar image forming apparatus, uses various types of auto document feeding devices that feed original documents having images to be read by an image reading device to an image reading position, and various types of sheet conveying devices that convey original documents to an image processing device. There is an auto document feeding device or a sheet conveying device that has been especially widely used, in which several original documents out of a stack of original documents (hereafter "sheets") are stacked on an original document setting table and picked up one by one by a sheet pick-up roller, and then conveyed by a sheet feeding belt and a reverse roller provided downstream of the sheet pick-up roller in the sheet conveying direction. Recently, in an auto document feeding device or a sheet conveying device that conveys original documents to an image reading position, various types of original documents have been used. For example, demands for copying a color copy sheet as an original document have increased.

In the above-described auto document feeding device of an image forming apparatus, for example, a stack of original documents are set on an original document setting table lying face-up so that a user can see the image of the original document. After the original document has been separated from the other original documents, and while it is conveyed to an image reading position, the original document is reversed. As a result, the image of the original document directs downward at the image reading position and is read by an image reading device located below the original document. The original documents are discharged from the auto document feeding device after their images have been read by the image reading device, and are sequentially stacked such that the front side of each page of the original documents directs downward. As a result, the original documents are stacked in a correct order of pages.

In the case of a color original document, silicone oil is often applied onto the surface of the color original document. When the silicone oil is adhered to a sheet pick-up roller and a sheet feeding belt, sheet feeding forces of the sheet pick-up roller and sheet feeding belt decrease as the number of sheets fed by the sheet pick-up roller and sheet feeding belt increases. As a result, problems, such as a sheet jam, typically occur. In the auto document feeding device or a sheet conveying device, a reverse roller is provided opposite a sheet feeding belt. When the sheet feeding belt and the reverse roller are driven, the sheet feeding belt and the reverse roller rotate in opposite directions. For example, when the sheet feeding belt feeds the first page of a stack of original documents toward the downstream side in the sheet feeding direction, the reverse roller obstructs the feeding of the second or following pages. Thus, because of the operations of the sheet feeding belt and the reverse roller, the original documents are fed one by one.

Because silicone oil is not adhered to the reverse roller, but is adhered to the sheet feeding belt and the sheet pick-up roller, the balance is lost between the reverse force (opposite the sheet moving direction) of the reverse roller and the forward forces of the sheet feeding belt and the sheet pick-up roller. Specifically, the reverse force of the reverse roller exceeds the sheet feeding forces of the sheet feeding belt and the sheet pick-up roller, thereby increasing the slip ratio of the sheets. Further, the slip of sheets may be caused by uneven application of silicone oil to the surface of an original document. For example, when a large amount of silicone oil is applied to the leading end portion of an original document, the original document may slip when being picked up by the sheet pick-up roller and may not slip after being picked up by the sheet pick-up roller. When a large amount of silicone oil is applied to the trailing end portion of an original document, the original document may slip after being picked up by the sheet pick-up roller.

In the above-described auto document feeding device or sheet conveying device, a pair of pull-out rollers (so-called sheet abutment rollers) are provided downstream of the sheet feeding belt in the sheet feeding direction. To reduce the size of the auto document feeding device or sheet conveying device, the devices are configured so that a drive motor is rotated in a forward direction for rotating the sheet pick-up roller and the sheet feeding belt, and the drive motor is rotated in a reverse direction for rotating a pull-out roller. In this configuration, an original document is picked up by the sheet pick-up roller and fed by the sheet feeding belt while the drive motor is rotated in the forward direction, and is then abutted against a nip part of the pull-out rollers in a halt condition while feeding the original document a distance greater than a sheet feeding path to perform a sheet skew correction. In the sheet skew correction, the leading edge of the original document is aligned, and thereby the posture and position of the original document are registered. The sheet feeding distance for abutting the original document against the nip part of the pull-out rollers is set based on information detected by a sensor provided immediately before the pull-out rollers. However, if the slip of the above-described color original document to which silicone oil is applied is not considered, the leading edge of the original document may not abut against the nip part of the pull-out rollers. In this case, a sheet feeding failure occurs at the pull-out rollers.

There is a background sheet feeding device that includes one sheet detecting device and a control device that controls the pulse number of a motor, which drives a sheet feeding roller. In this background sheet feeding device, the leading edge of a sheet fed by the sheet feeding roller passes the sheet detecting device, and abuts against a nip part of a pair of pull-out rollers in a halt condition. Subsequently, the sheet feeding roller rotates by a predetermined amount and a loop is formed on the sheet for a sheet skew correction. In this configuration, the control device controls a drive amount of the motor, after the leading edge of the sheet abuts against the nip part of the pull-out rollers, in accordance with the pulse number of the motor when the leading edge of the fed sheet passes the sheet detecting device. With this control of the drive amount of the motor, an adequate loop is formed on the sheet for the sheet skew correction.

However, in the above-described sheet feeding device, because the sheet feeding device uses only one sheet detecting device, the control device cannot determine at which point in the sheet feeding path between the sheet feeding roller and the pull-out rollers the sheet is delayed in its feeding. Further, the actual sheet feeding speed at the position adjacent to the pull-out rollers cannot be clearly determined. As a result, the drive amount of the motor necessary for performing a sheet skew correction may not be set with accuracy.

SUMMARY OF THE INVENTION

According to one aspect of the present invention, a sheet feeding apparatus includes a sheet feeding device configured to pick up sheets from stacked sheets and to feed the sheets one by one, a drive device configured to drive the sheet feeding device, a first detecting device configured to detect a sheet fed by the sheet feeding device to a first detection position located downstream of the sheet feeding device in a sheet feeding direction, a second detecting device configured to detect the sheet fed by the sheet feeding device to a second detection position located downstream of the first detecting device in the sheet feeding direction, and a control device configured to control sheet feeding while setting a drive amount of the drive device.

The control device calculates a first drive amount of the drive device during a first interval from when the first detecting device detects the sheet to when the second detecting device detects the sheet based on information detected by the first and second detecting devices. The control device determines if the sheet slips in the first interval based on the calculated first drive amount of the drive device, and sets a second drive amount of the drive device during a second interval from when the second detecting device detects the sheet to when the drive device is stopped based on the calculated first drive amount.

According to another aspect of the present invention, a sheet conveying apparatus includes a sheet feeding device configured to pick up sheets from stacked sheets and to feed the sheets one by one, a drive device configured to drive the sheet feeding device, a sheet conveying device configured to convey a sheet fed by the sheet feeding device to a predetermined position, a first detecting device provided between the sheet feeding device and the sheet conveying device to detect the sheet fed by the sheet feeding device, a second detecting device provided downstream of the first detecting device in a sheet feeding direction between the sheet feeding device and the sheet conveying device to detect the sheet fed by the sheet feeding device, and a control device configured to control sheet feeding while setting a drive amount of the drive device.

The control device calculates a first drive amount of the drive device during a first interval from when the first detecting device detects the sheet to when the second detecting device detects the sheet based on information detected by the first and second detecting devices. The control device determines if the sheet slips in the first interval based on the calculated first drive amount of the drive device, and sets a second drive amount of the drive device during a second interval from when the second detecting device detects the sheet to when the drive device is stopped based on the calculated first drive amount.

According to further aspect of the present invention, an image reading apparatus includes an image reading device configured to read an image of an original document at an image reading position, and the above-described sheet conveying apparatus.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
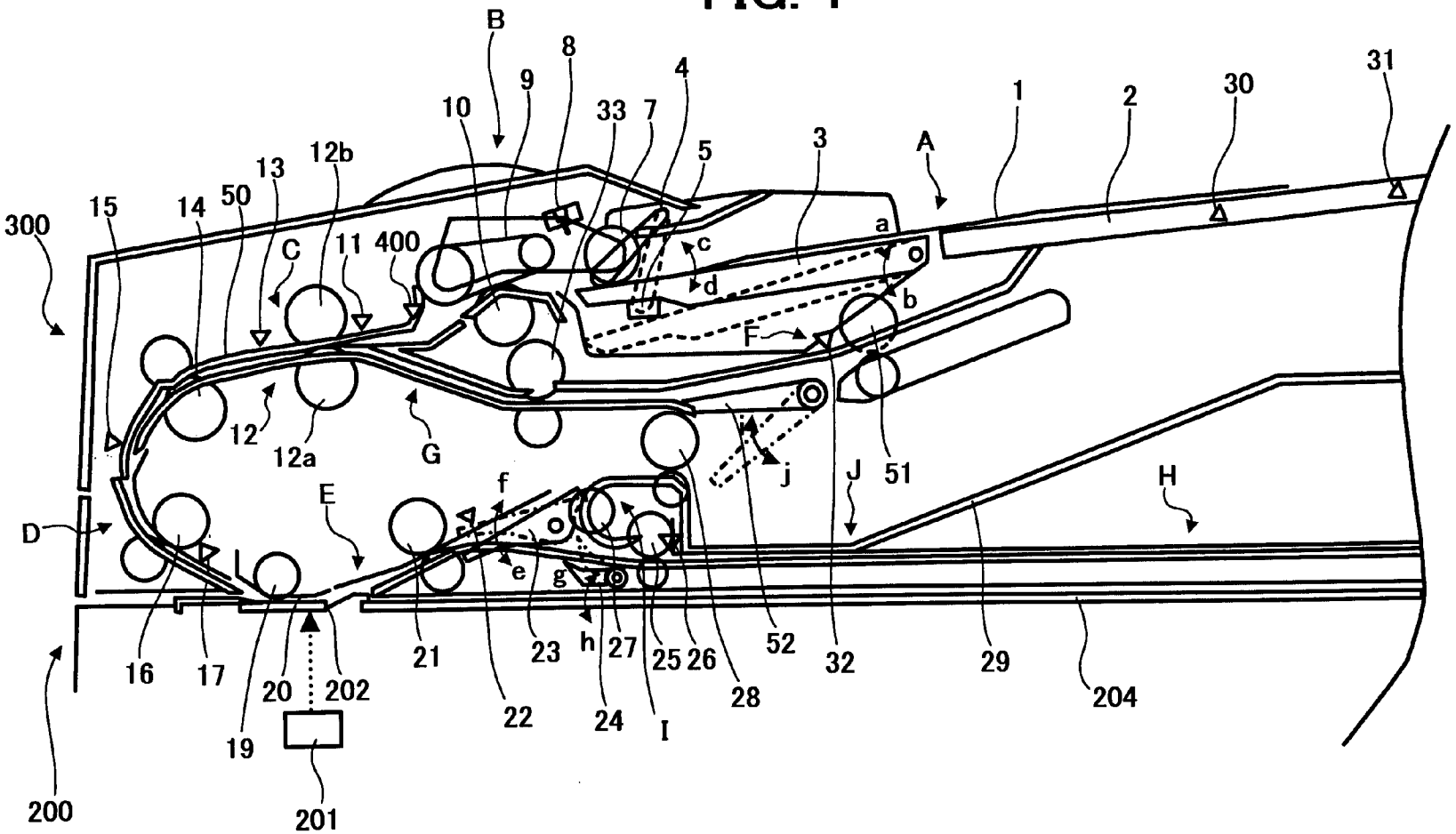
FIG. 1 is a cross section of a main construction of an image reading apparatus according to an embodiment of the present invention.

Preferred embodiments of the present invention are described in detail referring to the drawings, wherein like reference numerals designate identical or corresponding parts throughout the several views.

FIG. 1 is a cross section of a main construction of an image reading apparatus according to one embodiment of the present invention. Referring to FIG. 1, an auto document feeder 300 serving as a sheet feeding apparatus or a sheet conveying apparatus is connected to an upper portion of a main body 200 of an image reading apparatus via connection members, such that the auto document feeder 300 is openable and closable with respect to the main body 200 of the image reading apparatus.

An original document 1, which may be set atop a stack of other original documents (not shown), is set in an original document setting section (A) in the auto document feeder 300. The original document setting section (A) includes an original document setting table 2, a movable original document table 3, a set filler 4, a set sensor 5, a table rising sensor 8, a first original document length sensor 30, and a second original document length sensor 31. On the original document setting table 2, the original documents are set face-up. The movable original document table 3 is configured to move in the directions indicated by arrows (a) and (b) in FIG. 1. The set filler 4 rises when the original document 1, or a stack of original documents, is set on the original document setting table 2. The set sensor 5 detects by the position of the set filler 4 that the original document 1 is set on the original document setting table 2. The table rising sensor 8 detects that the movable original document table 3 rises to a predetermined position. A reflection type sensor or an actuator type sensor may be used for the first original document length sensor 30 and second original document length sensor 31 to detect the length of the original documents in the sheet feeding direction.

Referring further to FIG. 1, a sheet separating/feeding section (B) is configured to separate the original document 1 from the stack of the original documents set in the original document setting section (A) and to feed the original documents one by one. The sheet separating/feeding section (B) includes a sheet pick-up roller 7, a sheet feeding belt 9, a sheet separation roller 10, a first sensor 400, and a second sensor 11. The sheet pick-up roller 7 moves in the directions indicated by arrows (c) and (d), and picks up the original document 1 or several original documents from the stack of original documents set on the original document setting table 2. The sheet feeding belt 9 moves in the sheet feeding direction. The sheet separation roller 10 contacts the sheet feeding belt 9 to feed the original documents one by one while preventing the original documents from being double-fed. The sheet pick-up roller 7, the sheet feeding belt 9, and the sheet separation roller 10 construct a sheet feeding device. The first sensor 400 serving as a first detecting device detects the leading edge of the original document 1 separated from the stack of the original documents. The second sensor 11 serving as a second detecting device detects the leading edge of the original document 1 fed from the sheet feeding belt 9 and the sheet separation roller 10.

A registration section (C) has functions of registering the surface of the fed original document 1 and of conveying the registered original document 1. The registration section (C) includes a pair of pull-out rollers 12 and original document width sensors 13. The pull-out rollers 12 serve as a sheet conveying device and include a pull-out drive roller 12*a* and a pull-out driven roller 12*b*. The pull-out rollers 12 pull-out the original document 1 that is abutted against a nip part between the pull-out drive roller 12*a* and the pull-out driven roller 12*b* for a sheet skew correction. A plurality of original document width sensors 13 are arranged perpendicular to the conveying direction to detect the width of the original document 1.

Figure 2A:
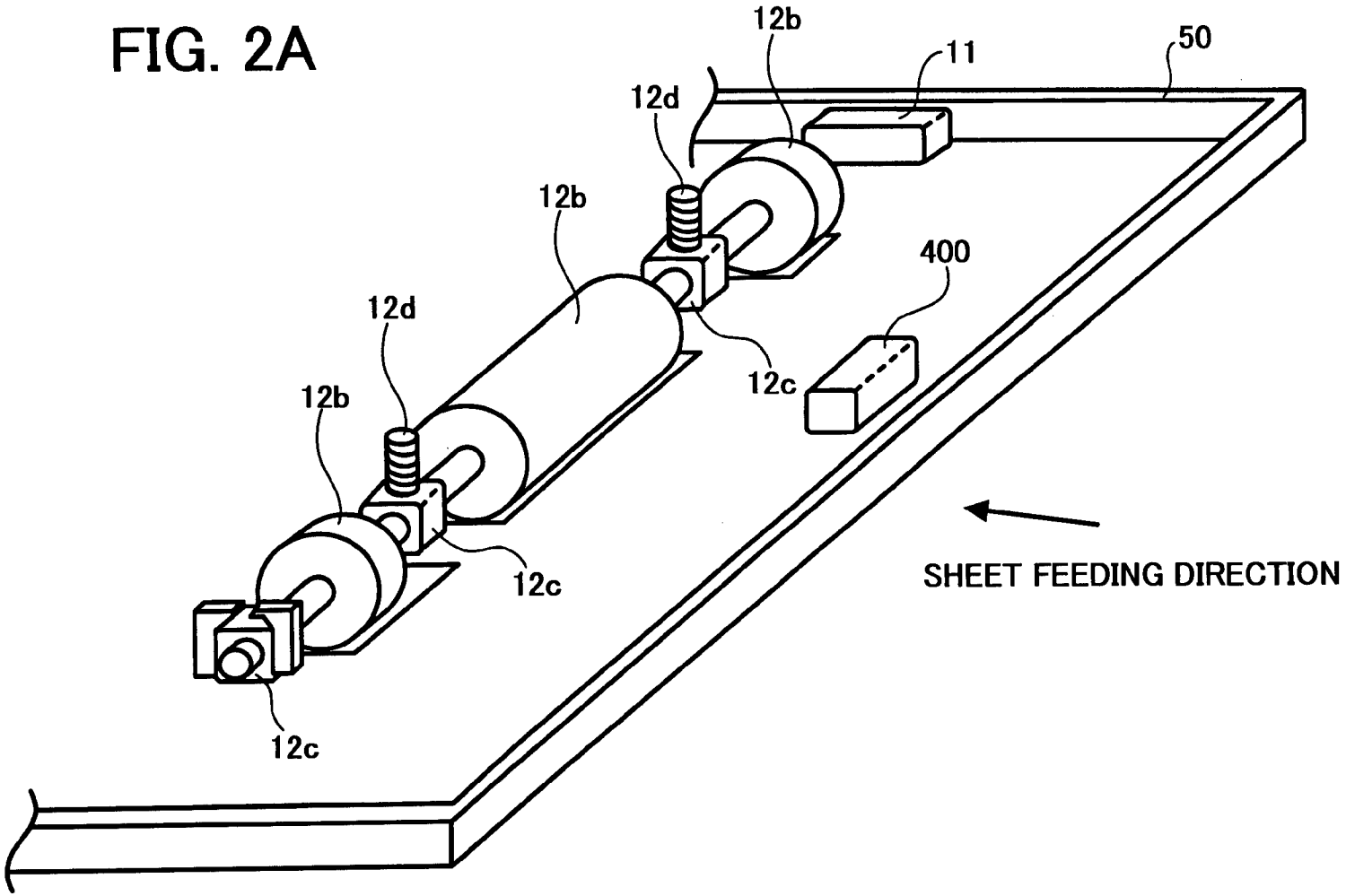
FIG. 2A is a perspective view of a part of an upper guide plate on which first and second sensors are provided according to an embodiment of the present invention.
Figure 2B:
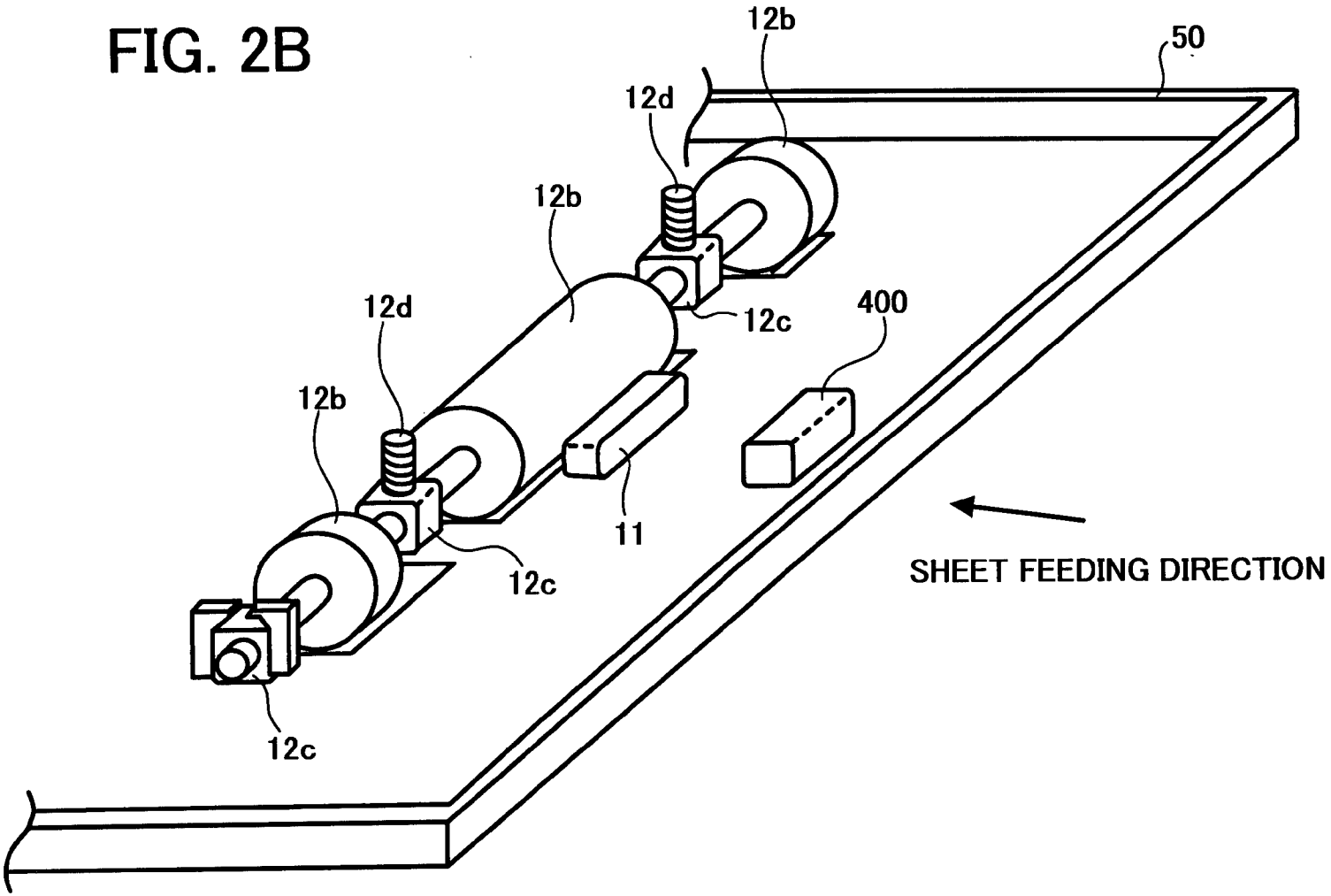
FIG. 2B is a perspective view of a part of an upper guide plate on which first and second sensors are provided according to an alternative example.

The pull-out drive roller 12*a* press-contacts the pull-out driven roller 12*b*. Referring to FIG. 2A, the pull-out drive rollers 12*a* (not shown) are pressed from above by springs 12*d* provided on bearings 12*c* on an upper guide plate 50, and thereby the pull-out driven rollers 12*b* are driven by the rotation of the pull-out drive rollers 12*a*. On the upper guide plate 50, as illustrated in FIG. 2A, the second sensor 11 is provided adjacent to the nip part between the pull-out drive roller 12*a* and pull-out driven roller 12*b*, in the axial direction of the pull-out driven roller 12*b*. Further, the first sensor 400 is provided upstream of the second sensor 11 in the sheet feeding direction. To secure a space for providing the second sensor 11, one side (i.e., on the side where the second sensor 11 is provided) of the shaft of the pull-out driven roller 12*b* is shortened with respect to the center of the shaft in the sheet conveying direction. To accurately detect the sheet skew of the original document 1 fed by the sheet feeding belt 9, it is preferable that the first sensor 400 and the second sensor 11 be arranged substantially in line in the sheet feeding direction as illustrated in FIG. 2B. Further, it is preferable that an interval between the first sensor 400 and the second sensor 11 be short so as not be affected by a sheet feeding speed variation caused by uneven application of oil to the surface of the original document 1.

In a reverse section (D), the conveyed original document 1 is reversed to direct the image side of the original document 1 downward. The image of the original document 1 is read by an image reading device 201 in the main body 200 of the image reading apparatus. The reverse section (D) includes a pair of reverse rollers 14, an entrance sensor 15, a pair of reading entrance rollers 16, and a registration sensor 17. The reverse rollers 14 convey the original document 1 while reversing it. The entrance sensor 15 detects the reversed original document 1. The reading entrance rollers 16 convey the reversed original document 1 to a registration position. The registration sensor 17 detects that the original document 1 reaches the registration position.

An image reading/sheet conveying section (E) functions to make the image of the original document 1 to be read from the lower side of a slit glass 202 while conveying the original document 1. The image reading/sheet conveying section (E) includes a roller 19, a reflection plate 20, and a pair of outlet rollers 21. The roller 19 conveys the original document 1 to an image reading position. The reflection plate 20 is used as a reference white plate and serves to prevent the original document 1 from floating from the slit glass 202. The outlet rollers 21 convey the original document 1 in the sheet discharging direction after the image of the original document 1 is read.

A switch-back section (F) retracts the read original document 1 and reverses front and rear sides of the original document 1. The switch-back section (F) includes a sheet discharging sensor 22, a dual sides switching pick 52, a pair of upper reversing rollers 51, and an upper reversing sensor 32. The sheet discharging sensor 22 detects the original document 1 that has been read by the image reading device 201. The dual sides switching pick 52 switches the sheet conveying directions between the directions indicated by arrows (i) and (j) in FIG. 1. The upper reversing rollers 51 convey the original document 1 in the retreating direction and the switch-back direction. The upper reversing sensor 32 detects the retreated original document 1.

An intermediate conveyance section (G) is configured to return the original document 1 that has been switch-backed in the switch-back section (F) to the registration section (C). The intermediate conveyance section (G) includes a pair of relay rollers 33. A switch-back section (H) is configured to temporarily hold the original document 1 after it has passed through the reverse section (D) and the image reading/sheet conveying section (E) in which the image of the rear side of the original document 1 was read. The switch-back section (H) includes a pair of lower reversing rollers 25, a lower reversing sensor 26, a lower reversing/sheet discharging switch pick 24, and a lower reversing switch pick 23. The lower reversing rollers 25 convey the original document 1 for retracting after the image of the rear side of the original document 1 is read. The lower reversing/sheet discharging switch pick 24 switches the sheet conveying direction between the directions indicated by arrows (g) and (h) in FIG. 1. The lower reversing switch pick 23 switches the sheet conveying direction between the directions indicated by arrows (e) and (f) in FIG. 1.

A sheet reversing/discharging section (I) is configured to reverse the original document 1 held in a standby condition in the switch-back section (H), and to discharge the original document 1 from the auto document feeder 300 by a pair of sheet discharging rollers 28. The sheet reversing/discharging section (I) includes an auxiliary roller 27 that helps convey the original document 1 that has been switch-backed by the lower reversing rollers 25. A sheet stack section (J) is configured to stack and hold the read original documents 1. The sheet stack section (J) includes a sheet discharging tray 29.

In the main body 200 of the image reading apparatus, an image reading device 201 reads an image of an original document by two types of image reading mechanisms. In one type of image reading mechanism, an image of an original document, which is placed on a platen glass 204, is read by moving an exposure lamp (not shown) and a first mirror (not shown) in the horizontal direction, in FIG. 1, below the platen glass 204. In the other type of image reading mechanism, the exposure lamp and first mirror halt at an image reading position (i.e., an exposure position) below a slit glass 202. An image of an original document conveyed in the auto document feeder 300 is read by the exposure lamp and the first mirror through the slit glass 202. The exposure lamp irradiates an image of an original document with light, and the reflected light from the image of the original document is led to an image reading element, such as a charge-coupled device (CCD) through the first mirror and lens (not shown), and imaged.

Figure 3:
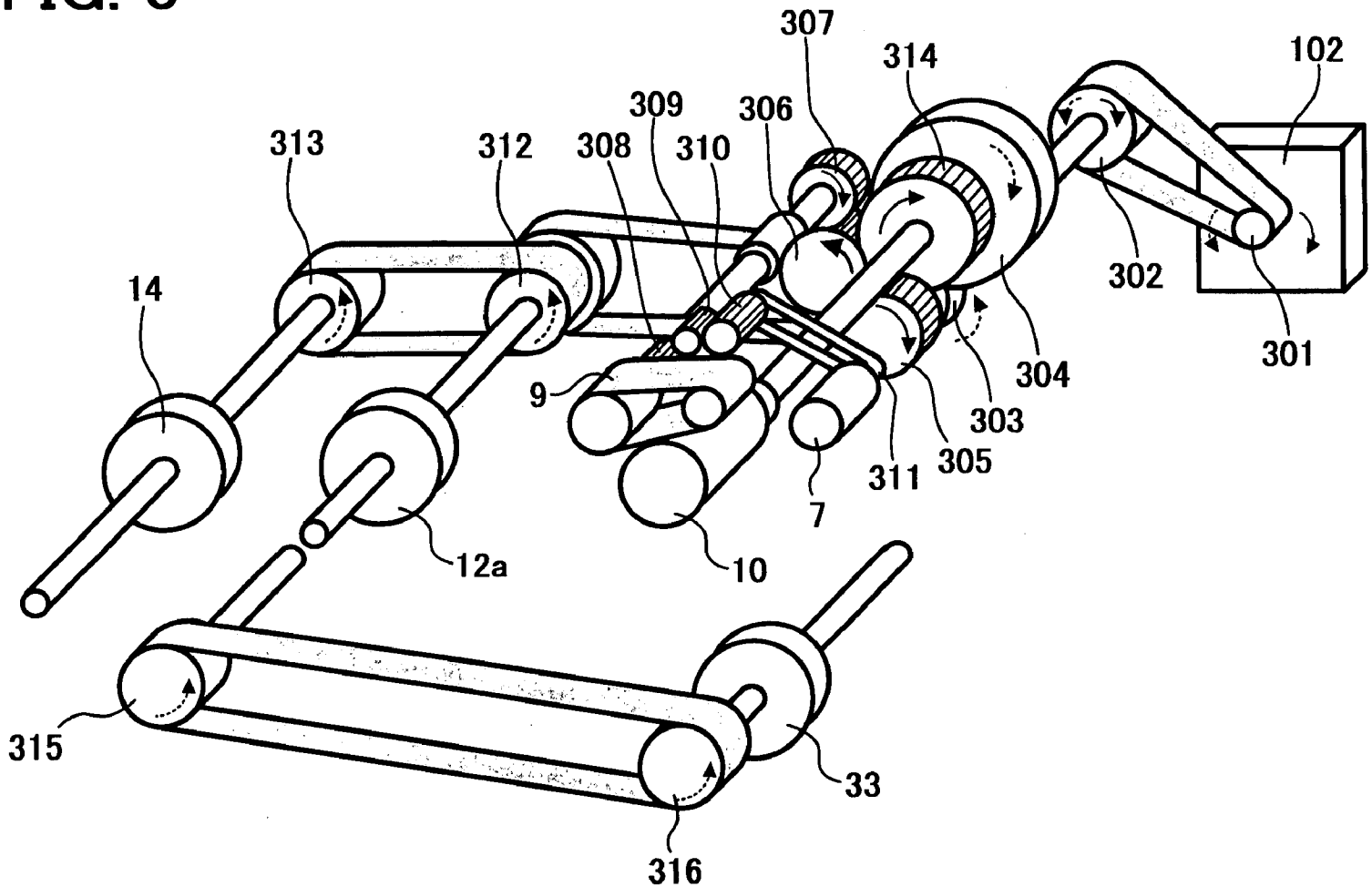
FIG. 3 is a perspective view of a drive system using a sheet feeding motor according to an embodiment of the present invention.
Figure 4:
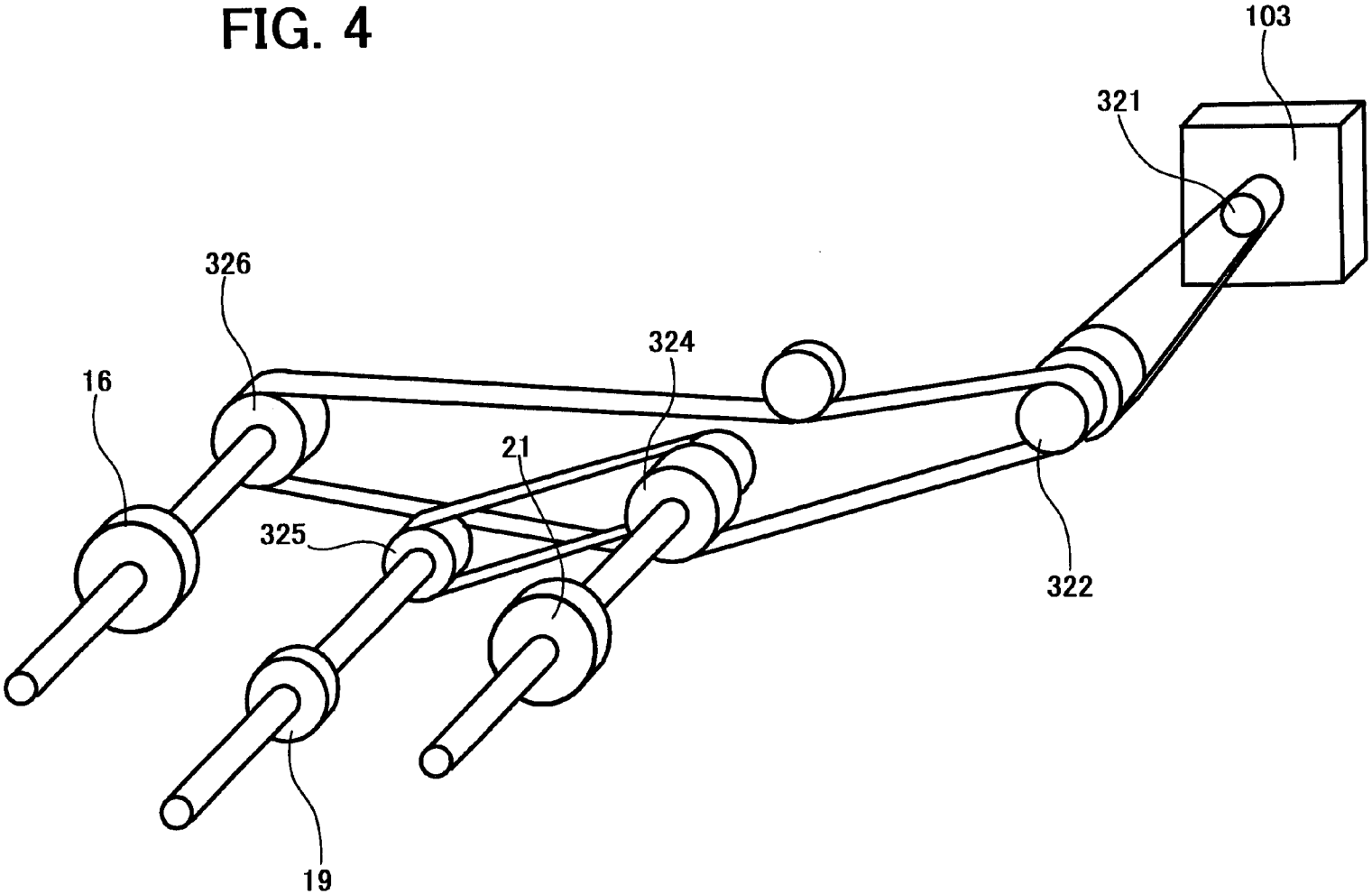
FIG. 4 is a perspective view of a drive system using an image reading motor according to an embodiment of the present invention.
Figure 5:
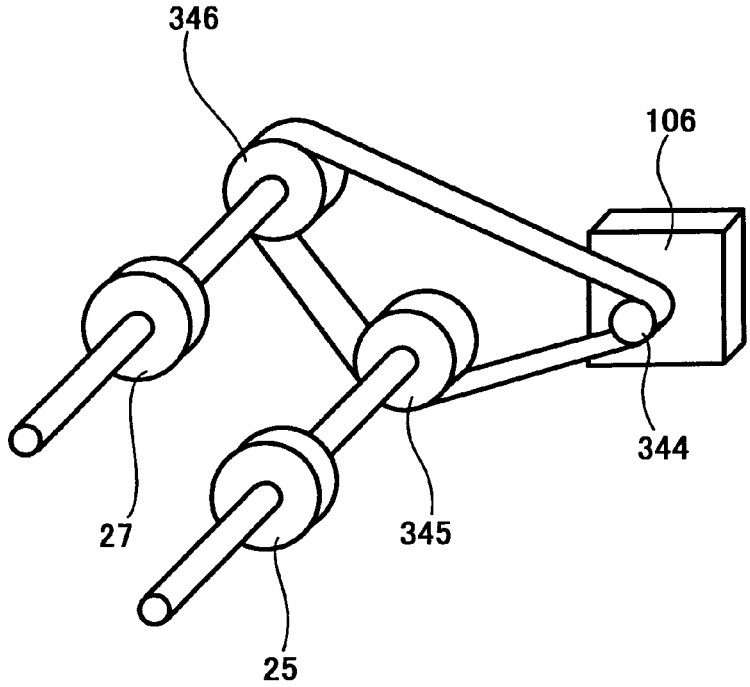
FIG. 5 is a perspective view of a drive system using a lower reversing motor according to an embodiment of the present invention.
Figure 6:
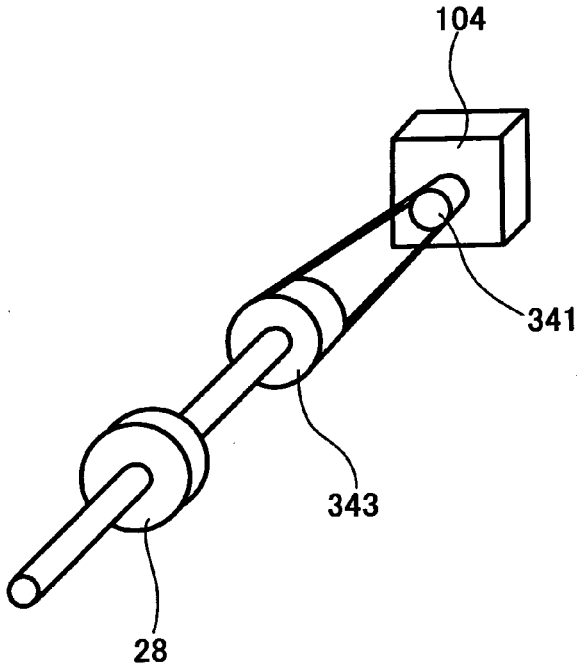
FIG. 6 is a perspective view of a drive system using a sheet discharging motor according to an embodiment of the present invention.
Figure 7:
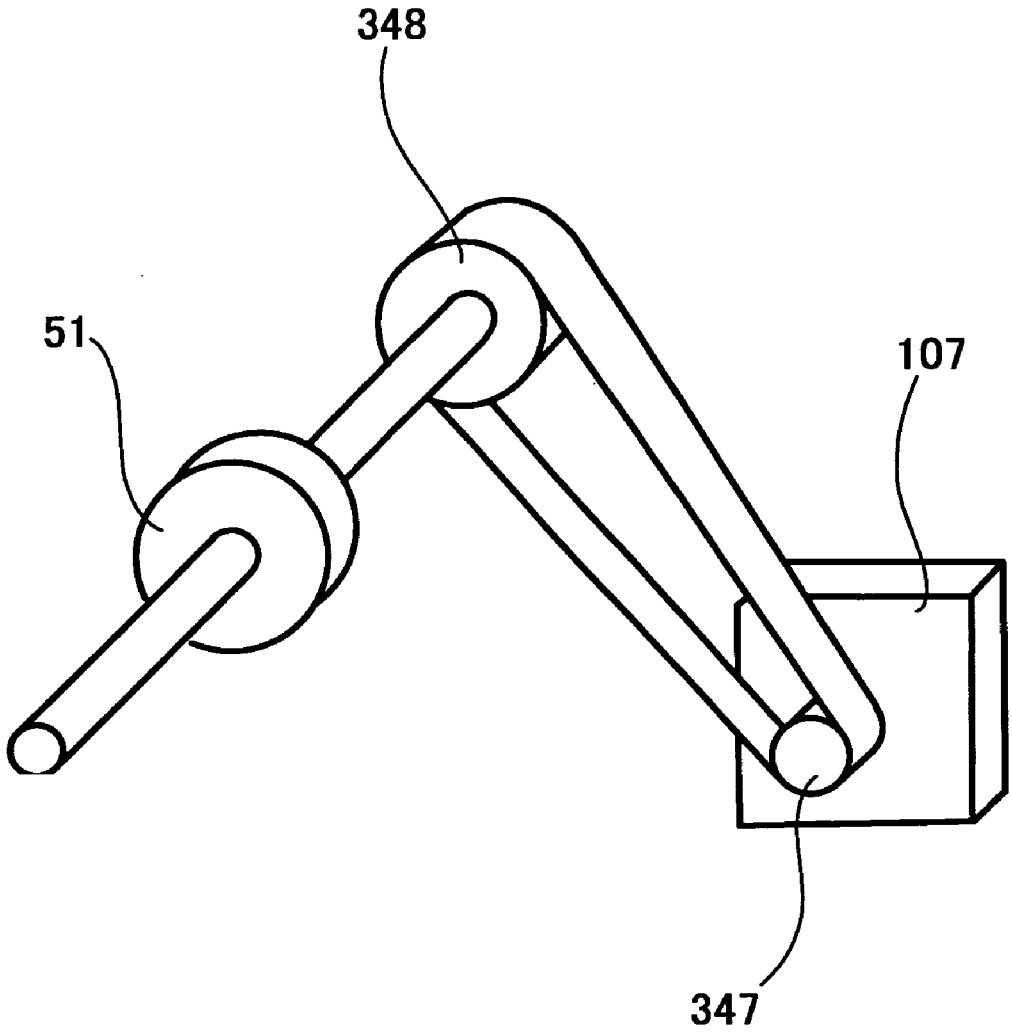
FIG. 7 is a perspective view of a drive system using an upper reversing motor according to an embodiment of the present invention.

Next, a drive system of an image reading apparatus according to the embodiment of the present invention will be described by referring to FIGS. 3 through 7. FIG. 3 illustrates a drive system using a sheet feeding motor 102. FIG. 4 illustrates a drive system using an image reading motor 103. FIG. 5 is a drive system using a lower reversing motor 106. FIG. 6 is a drive system using a sheet discharging motor 104. FIG. 7 is a drive system using an upper reversing motor 107.

In FIG. 3, the motor drive direction, for when the original documents 1 are picked up by the sheet pick-up roller 7 and fed one by one by the operations of the sheet feeding belt 9 and the sheet separation roller 10 (hereafter "sheet separation operation"), is indicated by solid arrows. The motor drive direction, for when the original documents 1 are conveyed by the pull-out rollers 12, the reverse rollers 14, and the relay rollers 33 (hereafter "sheet conveying operation"), is indicated by dotted arrows.

In the sheet separation operation, when the sheet feeding motor 102 serving as a drive device is driven to rotate, the drive force of the sheet feeding motor 102 is transmitted from a pulley 301 to a gear 306, via a pulley 302 and a gear 305. The drive force transmitted from the gear 306 to a gear 307 causes the sheet feeding belt 9 to rotate. Further, the drive force transmitted from a gear 308 to a pulley 311, via a gear 309 and a gear/pulley 310, causes the sheet pick-up roller 7 to rotate. The drive force transmitted from the gear 306 to a gear 314 causes the sheet separation roller 10 to rotate. At this time, a one-way clutch prevents transmission of the drive force to a gear pulley 303 coaxially provided to the gear 305, and to a gear 304 coaxially provided to the gear 314.

In the sheet conveying operation, when the sheet feeding motor 102 is driven to rotate, the drive force of the sheet feeding motor 102 is transmitted from the pulley 301 to the gear pulley 303, via the pulley 302. The drive force further transmitted from the gear pulley 303 to the gear 314 causes the sheet separation roller 10 to rotate. Further, the drive force transmitted from the gear pulley 303 to a pulley 313, via a pulley 312, causes reverse rollers 14 to rotate. The drive force transmitted from the pulley 312 to a pulley 316, via a pulley 315 causes the pull-out drive roller **12*a* and the relay rollers 33 to rotate. At this time, a one-way clutch prevents transmission of the drive force to the gear 305 coaxially provided to the gear pulley 303, and to the gear 314 coaxially provided to the gear 304**.

Referring to FIG. 4, when the image reading motor 103 is driven to rotate, the drive force of the image reading motor 103 is transmitted from a pulley 321 to a pulley 322. Further, the drive forces of the image reading motor 103 are transmitted from the pulley 322 to a pulley 324 and a pulley 326, thereby causing the reading entrance rollers 16 and the outlet rollers 21 to rotate. Further, the drive force of the image reading motor 103 is transmitted from the pulley 324 to a pulley 325, thereby rotating the roller 19.

Referring to FIG. 5, when the lower reversing motor 106 is driven to rotate, the drive force of the lower reversing motor 106 is transmitted from a pulley 344 to a pulley 346, via a pulley 345, thereby causing the lower reversing roller 25 and the auxiliary roller 27 to rotate.

Referring to FIG. 6, when the sheet discharging motor 104 is driven to rotate, the drive force of the sheet discharging motor 104 is transmitted from a pulley 341 to a pulley 343, thereby causing the sheet discharging roller 28 to rotate.

Referring to FIG. 7, when the upper reversing motor 107 is driven to rotate, the drive force of the upper reversing motor 107 is transmitted from a pulley 347 to a pulley 348, thereby causing the upper reversing roller 51 to rotate.

Figure 8:
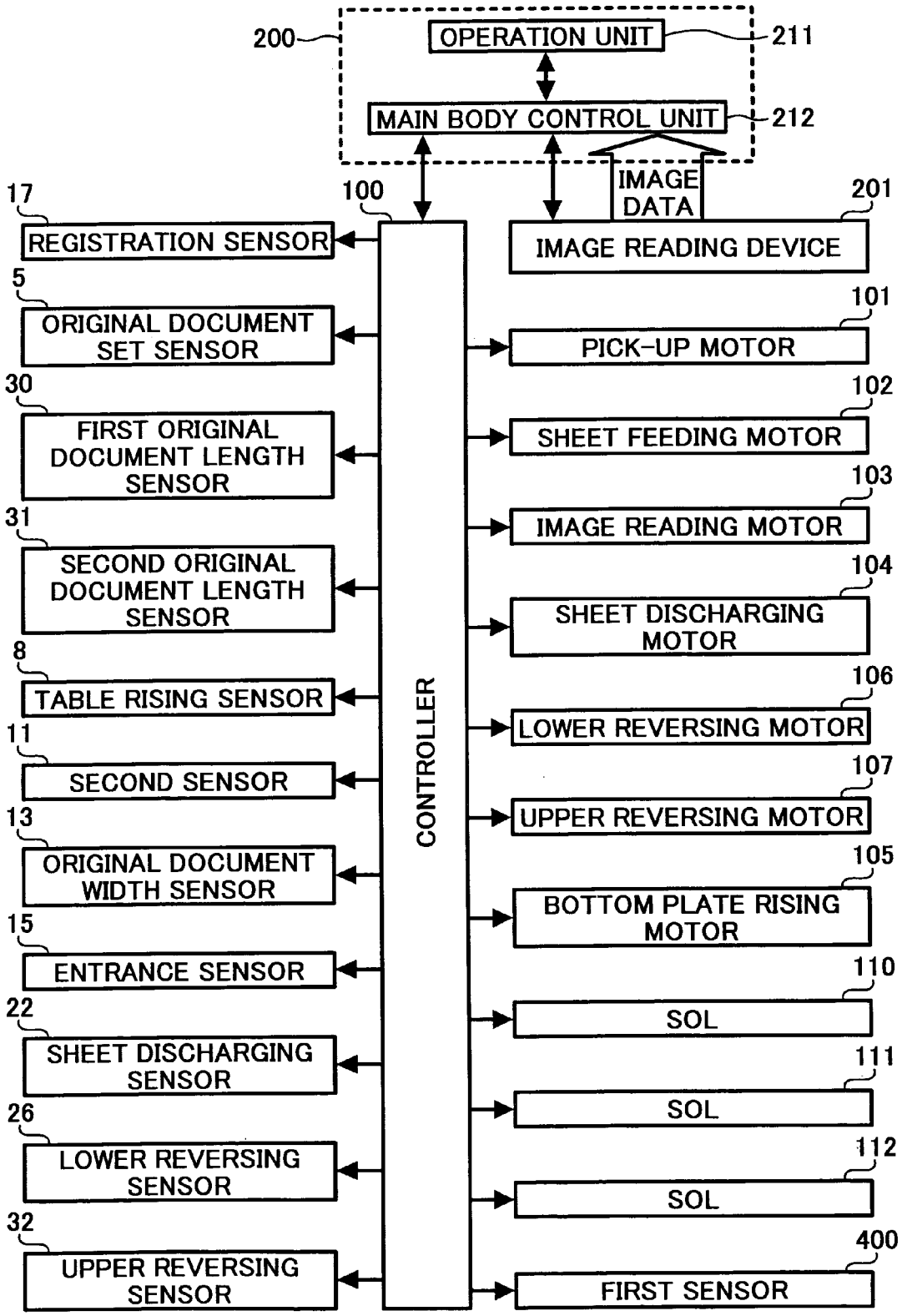
FIG. 8 is a block diagram of a control system in the image reading apparatus according to an embodiment of the present invention.

FIG. 8 is a block diagram of a control system that controls the above-described sections (A) through (I). The main body 200 of the image reading apparatus includes a main body control unit 212 that controls operations of the image reading apparatus. The main body control unit 212 receives signals transmitted from the auto document feeder 300 via a communication device, e.g., a serial communication line. The main body control unit 212 controls the drive of the image reading device 201 and the display of an operation unit 211 in accordance with received signals. The main body control unit 212 sends various types of control signals, such as operation mode signals and sheet feeding start signals, to the auto document feeder 300. The main body control unit 212 further controls a controller 100 to control sheet feeding and conveying operations of the auto document feeder 300.

The operation unit 211 includes various buttons (not shown), such as a start button, a reverse button, ten keys, and a liquid crystal display (LCD) panel. A user can set various operation modes and instruct the start and stop of operations of the apparatus via the operation unit 211. The information input and set from the operation unit 211 is stored in a Random Access Memory (RAM, not shown) in the main body control unit 212, and the stored information is updated every time the set information is changed.

The auto document feeder 300 includes the controller 100 that controls the sheet feeding and conveying operations of the auto document feeder 300. Various signals are input to the controller 100, such as detection signals sent from the above-described sensors 5, 6, 8, 11, 13, 15, 17, 22, 26, 30, 31, 32, 400, status signals from the motors 101–107 in the drive system and from solenoids 110–112, and control signals, such as sheet feeding start signals sent from the main body 200. The controller 100 sends detection information from each sensor to the main body control unit 212 in the main body 200 of the image reading apparatus. Further, the controller 100 drives the motors 101–107 and the solenoids 110–112 in accordance with control signals sent from the main body control unit 212.

Each motor is constructed with a stepping motor. Therefore, a drive amount of each motor is easily obtained by counting pulse numbers of the stepping motor and multiplying the counted pulse number by a drive amount per one pulse. Based on the calculated drive amount and information sent from each sensor, the length of the original document is detected. Further, the control of a sheet conveyance interval between a preceding sheet and a succeeding sheet, the control of a sheet arrival timing at an image reading position after the registration sensor 17 detects the original document 1, and the control of image reading completion timing are performed.

Hereafter, reasons for providing two sensors 11 and 400 at the positions between the sheet separating/feeding section (B) and the registration section (C) will be described.

Figure 9:
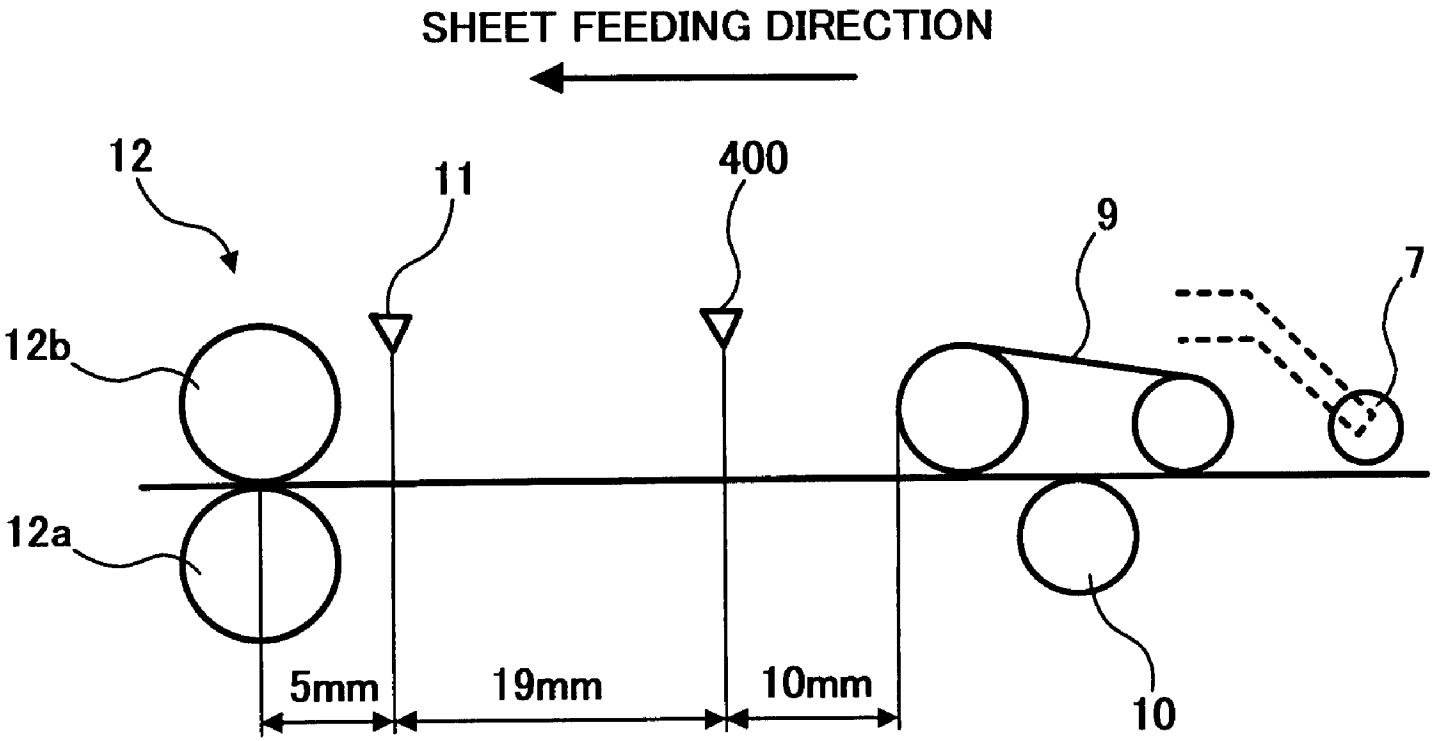
FIG. 9 is a schematic view for explaining spans between members in the sheet separating/feeding section according to an embodiment of the present invention.

As described above referring to FIG. 2A, the second sensor 11 is provided adjacent to the nip part between the pull-out drive roller 12*a* and pull-out driven roller 12*b*, in the axial direction of the pull-out driven roller 12*b*. The first sensor 400 is provided upstream of the second sensor 11 in the sheet feeding direction. As illustrated in FIG. 9, the span between the end portion of the sheet feeding belt 9 and the first sensor 400 is about 10 mm, the span between the first sensor 400 and the second sensor 11 is about 19 mm, and the span between the second sensor 11 and the nip part of the pull-out rollers 12 is about 5 mm.

An experiment of sheet feeding was performed in the auto document feeder 300 by using first and second original documents. Specifically, silicone oil was applied onto the first original document, and silicone oil was not applied onto the second original document (i.e., normal original document). The first and second original documents were fed into the auto document feeder 300 one by one. The time elapsed from the start of the sheet feeding to the arrival of the leading edge of the original document at the second sensor 11 was measured for each of the first and second original documents. The measurement results are shown in FIG. 10.

Figure 10:
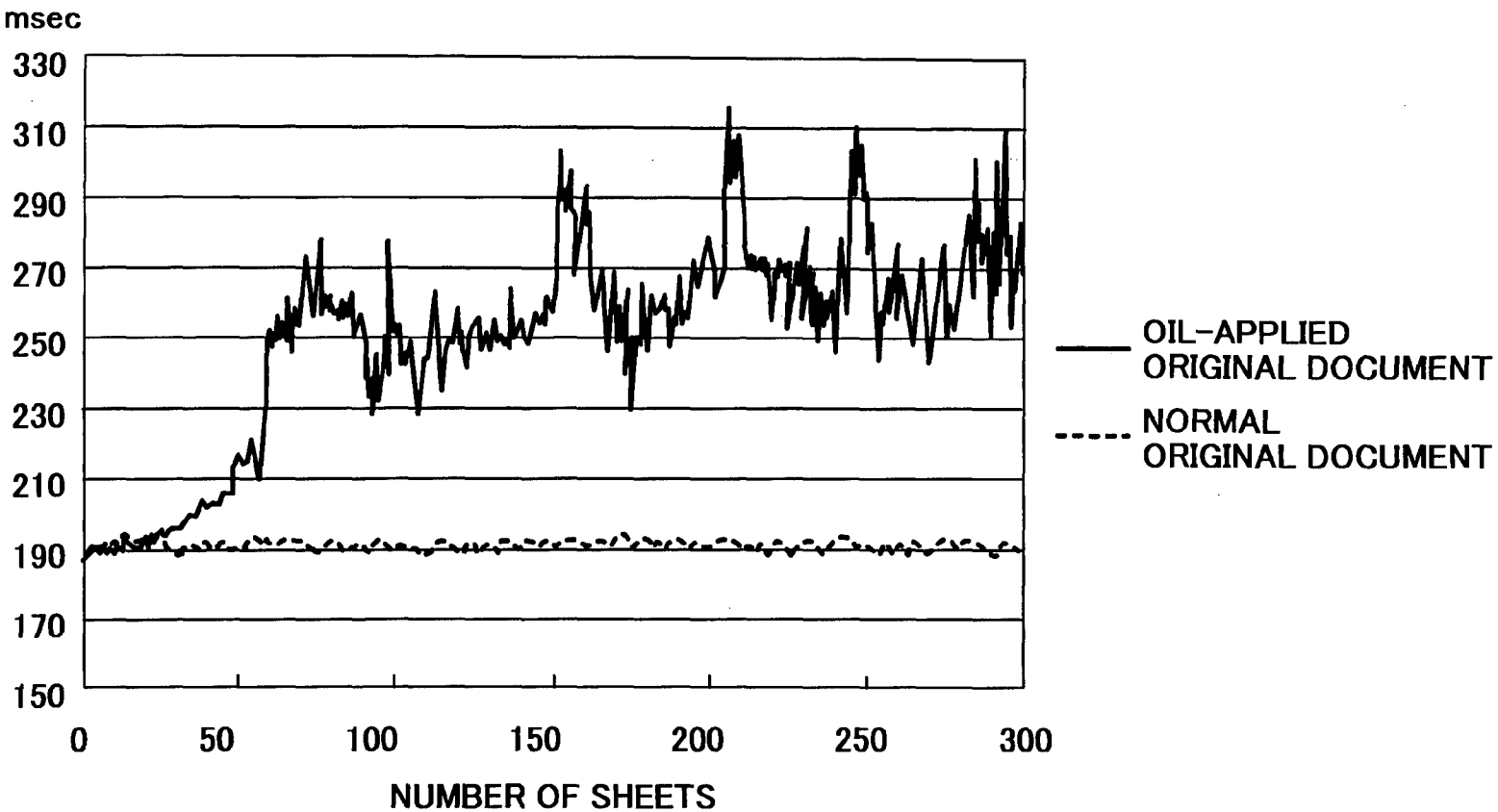
FIG. 10 is a graph showing a comparison of sheet feeding time between an oil-applied original document and a normal original document.

As seen from FIG. 10, when the second original documents (i.e., normal original documents) were fed into the auto document feeder 300, the measured time was relatively constant even if the number of fed sheets increased. When the first original documents (i.e., oil-applied original documents) were fed into the auto document feeder 300, as the number of fed sheets increased, the measured time gradually increased, due to the slip of the first original documents. The average maximum measured time was about 290 milliseconds. Another experiment of sheet feeding was performed in the auto document feeder 300 by using 30 sample sheets of the first original documents (i.e., oil-applied original documents) and an average sample of the second original document (i.e., normal original document). Specifically, the time elapsed from the start of the sheet feeding to the arrival of the leading edge of the original document at the first sensor 400 (first interval) was measured for each of the first and second original documents. Further, the time elapsed from the arrival of the leading edge of the original document at the first sensor 400 to the arrival of the leading edge of the original document at the second sensor 11 (second interval) was measured for each of the first and second original documents. The measurement results are shown in FIG. 11.

Figure 11:
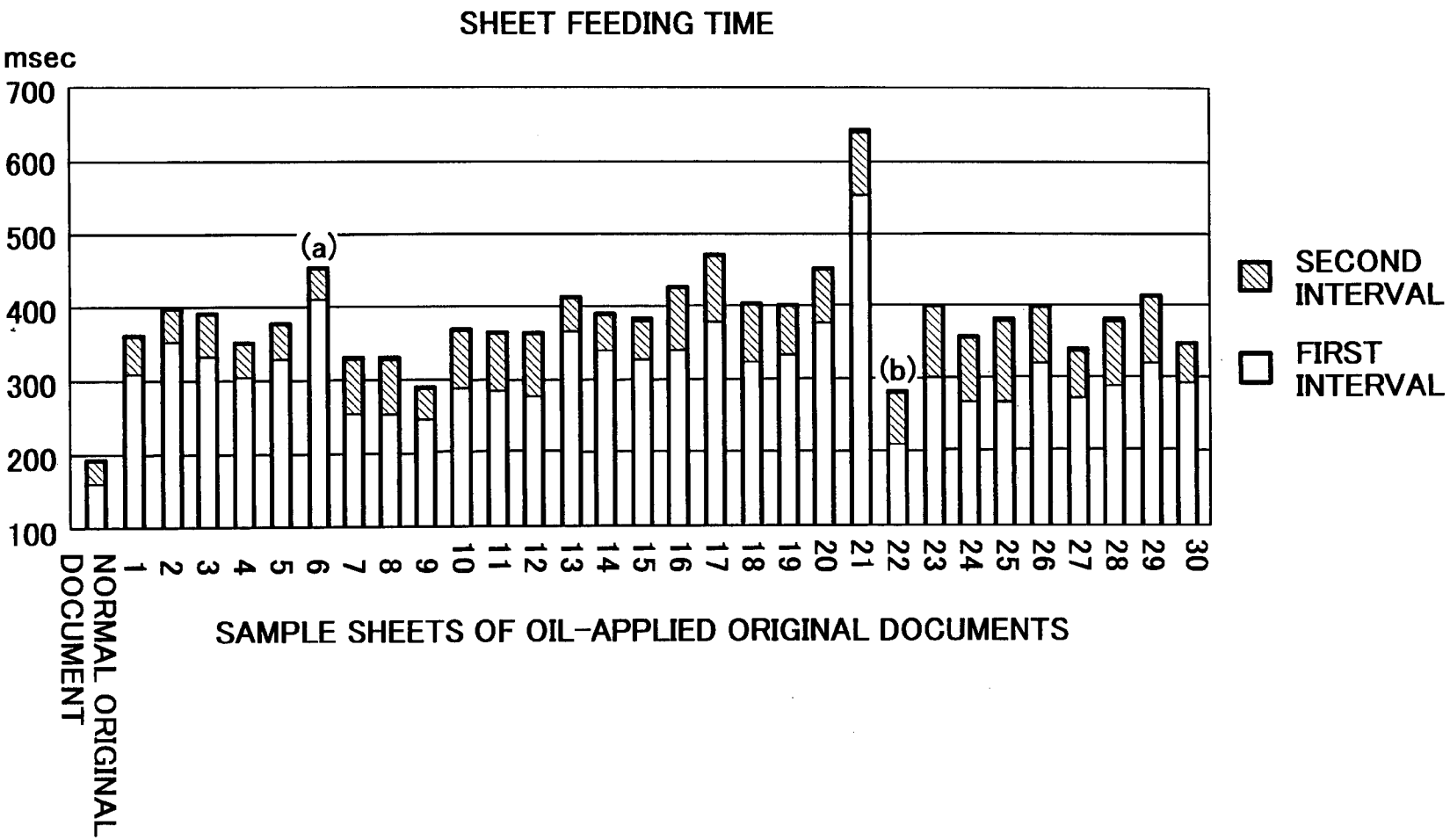
FIG. 11 is a graph showing a comparison of sheet feeding time of an oil-applied original document between first and second intervals.

As seen from FIG. 11, the sheet feeding time for the first original document is about two or three times longer than that for the second original document. However, there are variations between the sample sheets. In the case of sample sheet (a) in FIG. 11, the sheet feeding time for the sample sheet (a) in the first interval is longer due to slippage, but the sheet feeding time for the sample sheet (a) in the second interval is relatively short. On the other hand, in the case of sample sheet (b) in FIG. 11, the sheet feeding time for the sample sheet (b) in the first interval is relatively short, but the sheet feeding time for the sample sheet (b) in the second interval is relatively long. The reason for the variations is that the amount of the silicone oil applied onto the surface of the first original document is not even. When a large amount of the silicone oil is applied onto the tip portion of the first original document, it takes time for the first original document to be picked-up by the sheet pick-up roller 7 and separated from other sheets by the sheet feeding belt 9 and the sheet separation roller 10. When a small amount of the silicone oil is applied onto the tip portion of the first original document, the sheet feeding of the first original document is delayed in the second interval after the sheet is fed by the sheet feeding belt 9.

As described above, the delays of the sheet feeding of the original documents, onto which silicone oil is applied, are not even. Therefore, the actual original document feeding speed at the position adjacent to the pull-out rollers 12 cannot be measured with accuracy by using only one sensor, where the sensor measures the sheet feeding time after the sheet is fed by the sheet feeding belt 9. Thus, in this embodiment, the sheet feeding operation is controlled by using the second sensor 11 provided adjacent to the pull-out rollers 12, in addition to the first sensor 400 that measures the sheet feeding time after the sheet is fed by the sheet feeding belt 9.

Figure 12:
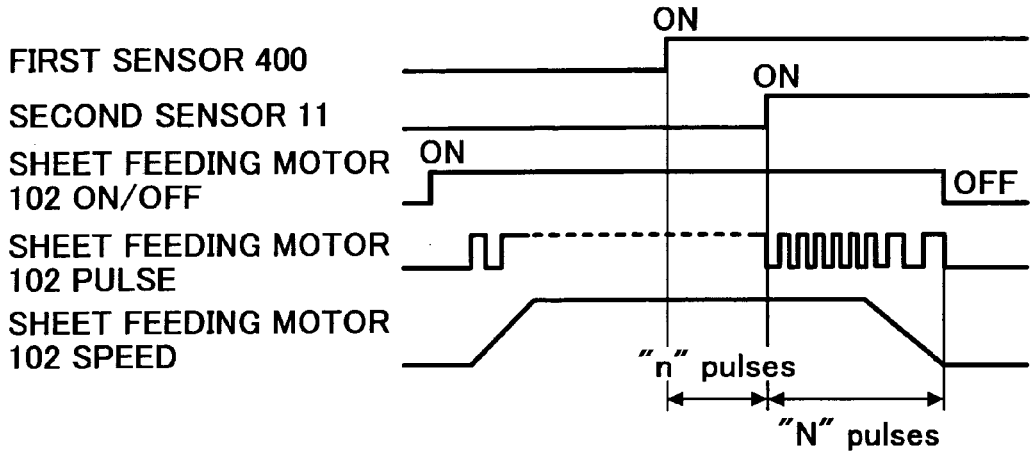
FIG. 12 is a timing chart of a sheet feeding operation in the image reading apparatus according to an embodiment of the present invention.

Next, the control of a sheet feeding operation in the image reading apparatus, including the auto document feeder 300 according to the present embodiment, will be described referring to FIG. 12. In this embodiment, the controller 100 detects if an original document fed by the sheet feeding belt 9 is an oil-applied original document based on the drive pulse number of the sheet feeding motor 102, which is counted from when the sheet feeding motor 102 drives the sheet pick-up roller 7 to pick up an original document to when the first sensor 400 detects the fed original document. The sheet feeding control operation described below is performed for the oil-applied original document detected by the controller 100. Therefore, the sheet feeding operation is efficiently controlled, thereby effectively preventing a sheet feeding failure at the pull-out rollers 12.

When the controller 100 detects that an oil-applied original document is fed by the sheet feeding belt 9, the controller 100 starts to count the pulse number of the sheet feeding motor 102, once the first sensor 400 detects the leading edge of the oil-applied original document fed by the sheet feeding belt 9. Assuming that "n" represents a number of counted pulses of the sheet feeding motor 102, during a period from when the first sensor 400 detects the leading edge of the oil-applied original document to when the second sensor 11 detects the leading edge of the oil-applied original document, the controller 100 calculates a pulse number "N" of the sheet feeding motor 102 necessary for feeding the oil-applied original document from the second sensor 11 to the nip part of the pull-out rollers 12, by the following equation, $$N=(n/(19\text{ mm}/0.1\text{ mm}))\times(5\text{ mm}/0.1\text{ mm}) \quad (1)$$

For example, if a sheet feeding amount per one pulse of the sheet feeding motor 102 when an original document is fed without slipping is 0.1 mm, since the span between the first sensor 400 and the second sensor 11 is 19 mm, the number of pulses of the sheet feeding motor 102 when the original document is fed without slipping in the span is obtained as 190 pulses (19 mm/0.1 mm). The ratio between 190 pulses and the counted "n" pulses is obtained as a sheet feeding delay ratio of the original document. Further, since the span between the second sensor 11 and the nip part of the pull-out rollers 12 is 5 mm, the above-described pulse number "N" of the sheet feeding motor 102 is obtained by multiplying 50 pulses (5 mm/0.1 mm) by the sheet feeding delay ratio of the original document.

The above-described pulse number "N" may be calculated based on the span (5 mm) between the second sensor 11 and the nip part of the pull-out rollers 12, plus a sheet abutment amount (several mm) for abutting the original document 1 against the pull-out rollers 12 in a halt condition for sheet skew correction. The sheet abutment amount equals the drive amount of the sheet feeding motor 102 that continues to drive the sheet feeding belt 9 even after the original document 1 reaches the pull-out rollers 12.

Next, a sheet feeding and conveying operation of the auto document feeder 300 will be described. A stack of original documents are set on the original document setting table 2 with the original documents face-up. The stack of original documents are positioned in their width direction by side guide plates (not shown). The set filler 4 and the set sensor 5 detect the setting of the original documents, and detection signals are transmitted to the main body control unit 212 via the serial communication line. Further, the original document length sensors 30 and 31 provided on the surface of the original document setting table 2 detect the length of the original document 1 in the sheet feeding direction.

Subsequently, the movable original document table 3 rises in the direction indicated by the arrow (a) in FIG. 1 by the forward rotation of a bottom plate rising motor 105, and thereby the uppermost sheet surface of the original documents 1 contacts the sheet pick-up roller 7. The sheet pick-up roller 7 moves in the direction indicated by the arrow (c) in FIG. 1 by a cam mechanism, while being driven by a pick-up motor 101. As described above, because the movable table 3 rises, the sheet pick-up roller 7 is lifted while being pressed by the top surface of the original documents 1 on the movable original document table 3. When the table rising sensor 8 detects the upper limit of the movable original document table 3, the bottom plate rising motor 105 is stopped, thereby stopping the sheet pick-up roller 7.

When an original document feeding signal is transmitted from the main body control unit 212 to the controller 100 via the serial communication line after a print key of the main body operation unit 211 is pressed, the sheet pick-up roller 7 is driven to rotate by the forward rotation of the sheet feeding motor 102, and thereby several sheets (one sheet is preferable) of the original documents 1 on the original document setting table 2 are picked up by the sheet pick-up roller 7. The rotation direction of the sheet pick-up roller 7 is equal to the sheet feeding direction.

Further, the sheet feeding belt 9 is driven to rotate in the sheet feeding direction by the forward rotation of the sheet feeding motor 102, and the sheet separation roller 10 is driven to rotate in the direction opposite to the sheet feeding direction. By these rotations of the sheet feeding belt 9 and the sheet separation roller 10, only the uppermost sheet of the original documents 1 is fed while separating the uppermost sheet from the other original documents 1. Specifically, the sheet separation roller 10 contacts the sheet feeding belt 9 with a predetermined pressure. When the sheet separation roller 10 is in direct contact with the sheet feeding belt 9 or in contact with the sheet feeding belt 9 via one sheet of the original document 1, the sheet separation roller 10 is rotated in a counter-clockwise direction by rotating the sheet feeding belt 9. When two or more sheets of the original documents enter the nip part between the sheet feeding belt 9 and the sheet separation roller 10, the sheet separation roller 10 rotates in the clockwise direction, i.e., its original drive direction, by the action of a torque limiter (not shown), such that sheets other than the uppermost sheet 1 are pushed back, thereby preventing the double-feeding of the original documents.

The original document 1, separated from the other original documents by the actions of the sheet feeding belt 9 and the sheet separation roller 10, is further fed by the sheet feeding belt 9, and the leading edge of the original document 1 is detected by the first sensor 400 and the second sensor 11. As described above, the controller 100 counts the pulse number of the sheet feeding motor 102 during a period from when the first sensor 400 detects the leading edge of the original document 1 to when the second sensor 11 detects the leading edge of the original document 1. Based on the counted pulse number of the sheet feeding motor 102, the controller 100 determines if the original document 1 slips in the period. Then, the controller 100 calculates a pulse number of the sheet feeding motor 102 necessary for feeding the original document 1 from the second sensor 11 to the nip part of the pull-out rollers 12, based on the counted pulse number of the sheet feeding motor 102. With the sheet feeding control operation by the controller 100, the drive amount of the sheet feeding motor 102 considering the actual sheet feeding speed of the original document 1 can be set. As a result, the original document 1 can be surely fed from the second sensor 11 to the nip part of the pull-out rollers 12.

Subsequently, the pair of pull-out drive rollers 12 are driven to rotate by the reverse rotation of the sheet feeding motor 102, thereby conveying the original document 1 to the reverse rollers 14. When the sheet feeding motor 102 is rotated in the reverse direction, the pull-out rollers 12 and the reverse rollers 14 are driven to rotate, but the sheet pick-up roller 7 and the sheet feeding belt 9 are not driven. The original document width sensors 13 detect the width of the original document 1 while being conveyed between the pull-out rollers 12. The length of the original document 1 in the sheet feeding direction is detected based on the motor pulses, by detecting the leading and trailing edges of the original document 1 via the second sensor 11.

When the leading edge of the original document 1 is detected by the entrance sensor 15, before the leading edge of the original document 1 enters the nip part between the pair of entrance rollers 16, the conveying speed of the original document 1 is reduced to be equal to the image reading speed. Almost simultaneously, the reading entrance rollers 16, the roller 19, and the outlet rollers 21 are driven by rotating the image reading motor 103 in the forward direction.

Subsequently, when the leading edge of the original document 1 is detected by the registration sensor 17, the image reading device 201 is operated at an appropriate timing to read an image of the original document 1.

When reading an image on one side of the original document 1, the lower reversing switch pick 23 and the dual sides switching pick 52 are in the positions indicated by the solid lines in FIG. 1. The original document 1, having passed through the image reading/sheet conveying section (E), is conveyed to the sheet discharging section (J). At this time, when the leading edge of the original document 1 is detected by the sheet discharging sensor 22, the sheet discharging motor 104 is rotated in the forward direction, thereby rotating the sheet discharging roller 28 in the counter-clockwise direction. Further, by counting pulses of the sheet discharging motor 104 from the time when the sheet discharging sensor 22 detects the trailing edge of the original document 1, the driving speed of the sheet discharging motor 104 is reduced immediately before the trailing edge of the original document 1 passes through a nip part between the pair of sheet discharging rollers 28. Thus, the original document 1, discharged on the sheet discharging tray 29, is prevented from jumping out from the sheet discharging tray 29.

In this embodiment, the controller 100 controls the sheet feeding operation by counting the pulse number of the sheet feeding motor 102. Therefore, even if the default setting for sheet feeding speed is changed, the sheet feeding operation can be controlled in the same way.

As an alternative to controlling sheet feeding by counting the pulse number of the sheet feeding motor 102, sheet feeding can be controlled by using an encoder provided on a roller shaft for the sheet feeding belt 9.

Figure 13:
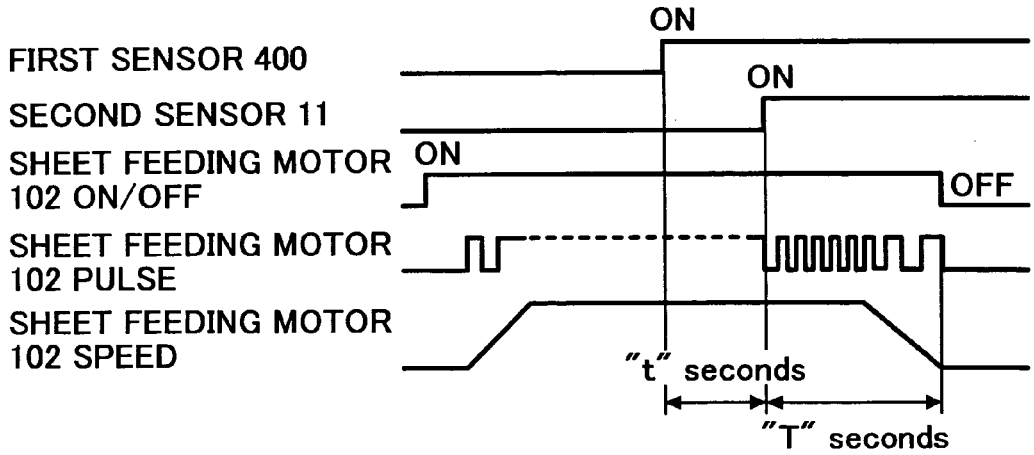
FIG. 13 is a timing chart of a sheet feeding operation in the image reading apparatus according to another embodiment of the present invention.

FIG. 13 is a timing chart of a sheet feeding operation in the image reading apparatus, including the auto document feeder 300, according to another embodiment of the present invention. In this embodiment, the control of a sheet feeding operation is substantially similar to that in the previous embodiment, except that the controller 100 controls the sheet feeding operation by measuring a sheet feeding time of the sheet feeding motor 102.

In this embodiment, the controller 100 detects if an original document fed by the sheet feeding belt 9 is an oil-applied original document based on the lapse of time from when the sheet feeding motor 102 drives the sheet pick-up roller 7 to pick up an original document to when the first sensor 400 detects the fed original document. The sheet feeding control operation described below is performed for the oil-applied original document detected by the controller 100. Therefore, the sheet feeding operation is efficiently controlled, thereby effectively preventing a sheet feeding failure at the pull-out rollers 12.

When the controller 100 detects that an oil-applied original document is fed by the sheet feeding belt 9, the controller 100 starts to measure a sheet feeding time from when the first sensor 400 detects the leading edge of the oil-applied original document fed by the sheet feeding belt 9. Assuming that "t" represents a value of measured sheet feeding time, during a period from when the first sensor 400 detects the leading edge of the oil-applied original document to when the second sensor 11 detects the leading edge of the oil-applied original document, the controller 100 calculates a time "T" necessary for feeding the oil-applied original document from the second sensor 11 to the nip part of the pull-out rollers 12 by the following equation, $$T=(t/(19\text{ mm}/590\text{ mm/s}))\times(5\text{ mm}/590\text{ mm/s}) \quad (2)$$

For example, if a sheet feeding speed of the original document 1 driven by the sheet feeding motor 102 when the original document is fed without slipping is 590 mm/s, because the span between the first sensor 400 and the second sensor 11 is 19 mm, the sheet feeding time during which the original document is fed without slipping in the span is 0.032 seconds (19 mm/590 mm/s). The ratio between 0.032 seconds and the measured "t" seconds is obtained as a sheet feeding delay ratio of the original document. Further, because the span between the second sensor 11 and the nip part of the pull-out rollers 12 is 5 mm, the above-described time "T" is obtained by multiplying 0.0085 seconds (5 mm/590 mm/s) by the sheet feeding delay ratio of the original document.

In this embodiment, the controller 100 controls the sheet feeding operation by using a timer to measure a sheet feeding time of the sheet feeding motor 102. Therefore, effects similar to those in the previous embodiment can be obtained in an auto document feeder that does not use a stepping motor.

Figure 14:
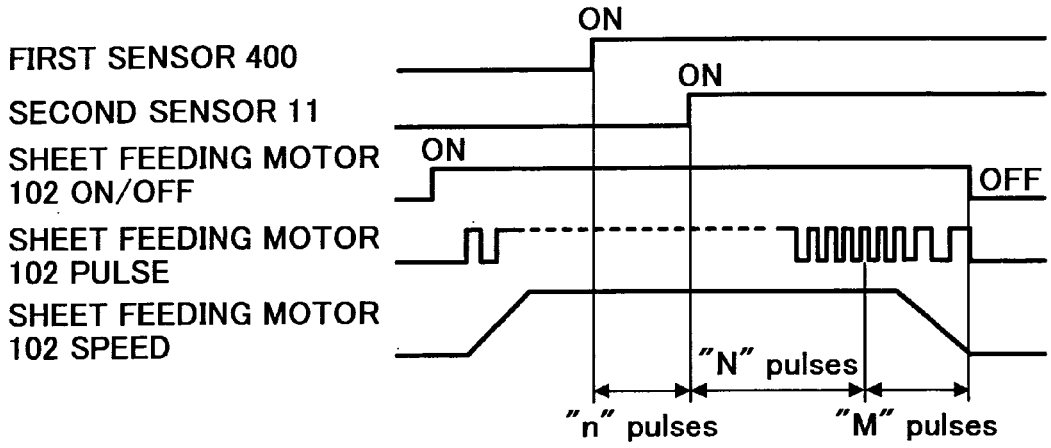
FIG. 14 is a timing chart of a sheet feeding operation in the image reading apparatus according to another embodiment of the present invention.

FIG. 14 is a timing chart of a sheet feeding operation in the image reading apparatus, including the auto document feeder 300 according to another embodiment of the present invention.

In this embodiment, the original document 1 is fed from the sheet feeding belt 9 and then abutted against a nip part of the pull-out rollers 12 in a halt condition, while the original document 1 is fed a distance greater than a sheet feeding path, to perform a sheet skew correction. As a result, the sheet feeding motor 102 and the sheet feeding belt 9 stop when the leading edge of the original document 1 is pressed against the nip part of the pull-out rollers 12, and thereby a leading edge portion of the original document 1 is flexed. Specifically, the sheet pick-up roller 7 moves away from the upper surface of the original document 1 while being driven by the pick-up motor 101. Therefore, the original document 1 is fed only by the feeding force of the sheet feeding belt 9, and thereby the leading edge of the original document 1 enters the nip part of the pull-out rollers 12. As a result, the leading edge of the original document 1 is aligned, so that a sheet skew is corrected.

Further, in this embodiment, the amount of abutting by the original document against the nip part of the pull-out rollers 12 (hereafter simply referred to as a sheet abutment amount), for an original document having a tendency to slip (e.g., an oil-applied document), is controlled to be greater than that for a normal original document in which the occurrence of slips is within an allowable range.

The reason why the sheet abutment amount is different for the normal original document and the original document having a tendency to slip is as follows. To correct the skew of the original document, the original document must undertake an appropriate flection by abutting its leading edge against the nip part of the pull-out rollers 12 in a halt condition, while it is driven for feeding. If a sheet abutment amount is insufficient when the original document having a tendency to slip is fed, the flection of the original document is reduced. Further, if the original document is skewed severely, the leading edge of the original document does not reach the nip part of the pull-out rollers 12. In this case, the skew of the original document is not corrected, and the skewed original document is not conveyed from the pull-out rollers 12. Through the experiments performed by the present inventors, it was found that the skew of the original document having a tendency to slip can be effectively corrected by making the sheet abutment amount for the original document greater than that for a normal original document. Therefore, in this embodiment, the sheet abutment amount for the normal original document is set to about 2 mm, and the sheet abutment amount for the original document having a tendency to slip is set to about 4 mm.

In this embodiment, the controller 100 counts a pulse number "n" of the sheet feeding motor 102 during a period from when the first sensor 400 detects the leading edge of the original document to when the second sensor 11 detects the leading edge of the original document. Subsequently, the controller 100 determines if the original document slips or not by comparing the counted pulse number "n" with a predetermined pulse number. The predetermined pulse number is obtained by adding a value "$\alpha 1$" (e.g., several tens of pulses), considering the dispersion to the theoretical pulse number (19 mm/0.1 mm) when a slip of the original document does not occur.

When the controller 100 determines that an original document does not slip or that the slip of the original document is in an allowable range (i.e., $n \leqq (19\ mm/0.1\ mm)+\alpha 1$), this is considered a normal sheet feeding, and the original document is fed and stopped such that the sheet abutment amount against the pull-out rollers 12 becomes about 2 mm. In this case, a pulse number "M" of the sheet feeding motor 102 for setting the abutment amount of the original document (hereafter referred to as a sheet abutment amount pulse number "M") is obtained by dividing 2 mm with 0.1 mm. As described above, 0.1 mm is a sheet feeding amount per one pulse of the sheet feeding motor 102 when an original document is fed without slipping.

When the controller 100 determines that an original document slips (i.e., $n>(19\ mm/0.1\ mm)+\beta 1$), the pulse number "N" of the sheet feeding motor 102 necessary for feeding the original document from the second sensor 11 to the nip part of the pull-out rollers 12 is obtained by the equation (1)

$$N=(n/(19\ mm/0.1\ mm))\times(5\ mm/0.1\ mm) \quad (1)$$

The sheet abutment amount pulse number "M" is set by multiplying the coefficient, considering the slip ratio, such that the actual sheet abutment amount becomes about 4 mm. Specifically, as shown in an equation (3), the sheet abutment amount pulse number "M" is obtained by multiplying a sheet feeding delay ratio (n/(19 mm/0.1 mm)) by a theoretical pulse number (4 mm/0.1 mm) necessary for feeding an original document about 4 mm.

$$M=(n/(19\ mm/0.1\ mm))\times(4\ mm/0.1\ mm) \quad (3)$$

In the above-described sheet feeding apparatus or sheet conveying apparatus, according to the embodiment of the present invention, when the controller 100 determines that the original document slips in a sheet feeding path, the controller 100 sets the sheet abutment amount pulse number "M" while considering the possibility of a slip of the original document between the second sensor 11 and the pull-out rollers 12. Thus, even if an original document has a tendency to slip, an adequate sheet abutment amount against the nip part of the pull-out rollers 12 can be set, thereby correcting sheet skew adequately. As a result, a sheet feeding failure at the pull-out rollers 12 due to sheet skew can be prevented.

Figure 15:
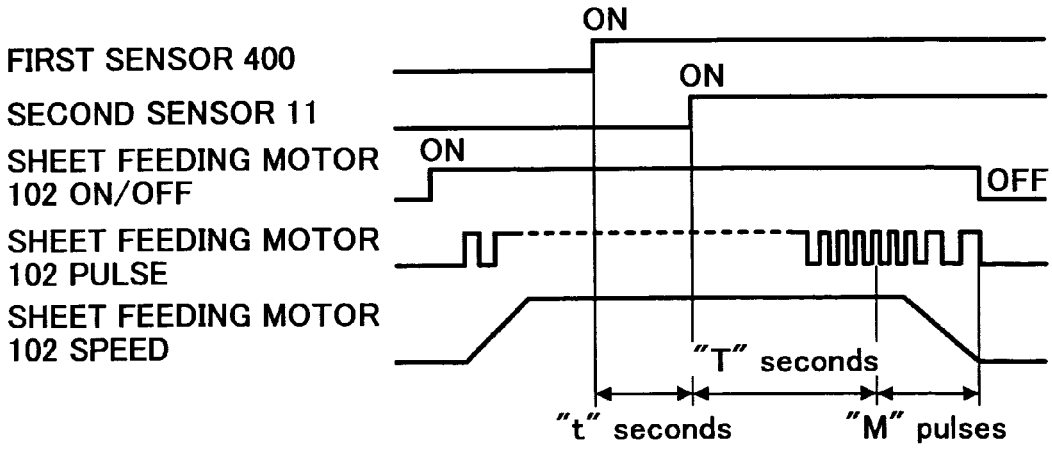
FIG. 15 is a timing chart of a sheet feeding operation in the image reading apparatus according to another embodiment of the present invention.

FIG. 15 is a timing chart of a sheet feeding operation in the image reading apparatus, including the auto document feeder 300, according to another embodiment of the present invention. In this embodiment, the control of a sheet feeding operation is substantially similar to that in the previous embodiment except that the controller 100 controls the sheet feeding operation by measuring a sheet feeding time of the sheet feeding motor 102.

As described in the previous embodiment, the controller 100 calculates the sheet feeding delay ratio of an oil-applied original document, and obtains the time "T" necessary for feeding the oil-applied original document from the second sensor 11 to the nip part of the pull-out rollers 12 by the equation (2)

$$T=(t/(19\ mm/590\ mm/s))\times(5\ mm/590\ mm/s) \quad (2)$$

As described above, the "t" represents a value of measured sheet feeding time during a period from when the first sensor 400 detects the leading edge of the oil-applied original document to when the second sensor 11 detects the leading edge of the oil-applied original document.

The controller 100 determines if the original document slips by comparing the measured time "t" with a predetermined time. The predetermined time is obtained by adding a value "$\alpha 2$", (e.g., several tens of seconds) considering the dispersion to the theoretical sheet feeding time (19 mm/0.1 mm/s) when a slip of the original document does not occur.

When the controller 100 determines that an original document does not slip or that the slip of the original document is in an allowable range (i.e., $t \leqq (19\ mm/590\ mm/s)+\alpha 2$), this is considered a normal sheet feeding, and the original document is fed and stopped such that the sheet abutment amount against the pull-out rollers 12 becomes about 2 mm. In this case, the sheet abutment amount pulse number "M" is obtained by dividing 2 mm with 0.1 mm. As described above, 0.1 mm is a sheet feeding amount per one pulse of the sheet feeding motor 102 when an original document is fed without slipping.

When the controller 100 determines that an original document slips (i.e., $t>(19\ mm/590\ mm/s)+\alpha 2$), the time "T" necessary for feeding the original document from the second sensor 11 to the nip part of the pull-out rollers 12 is obtained by the equation (2)

$$T=(t/(19\ mm/590\ mm/s))\times(5\ mm/590\ mm/s) \quad (2)$$

The sheet abutment amount pulse number "M" is set by multiplying the coefficient, considering the slip ratio, such that the actual sheet abutment amount becomes about 4 mm. Specifically, as shown in an equation (4), the sheet abutment amount pulse number "M" is obtained by multiplying a sheet feeding delay ratio (t/(19 mm/590 mm/s)) by a theoretical pulse number (4 mm/0.1 mm) necessary for feeding an original document by about 4 mm.

$$M=(t/(19\text{ mm}/590\text{ mm/s}))\times(4\text{ mm}/0.1\text{ mm}) \quad (4)$$

Figure 16A:
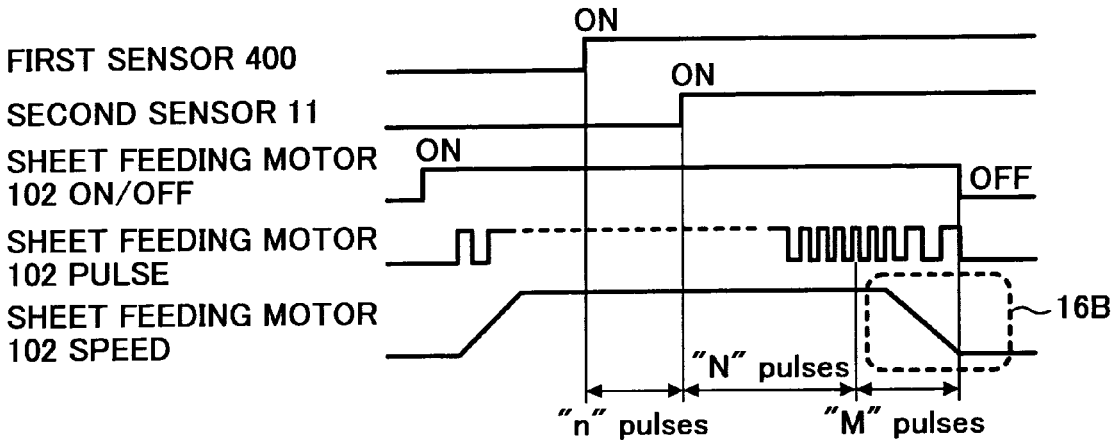
FIG. 16A is a timing chart of a sheet feeding operation when an original document slips in the image reading apparatus according to another embodiment of the present invention.
Figure 17A:
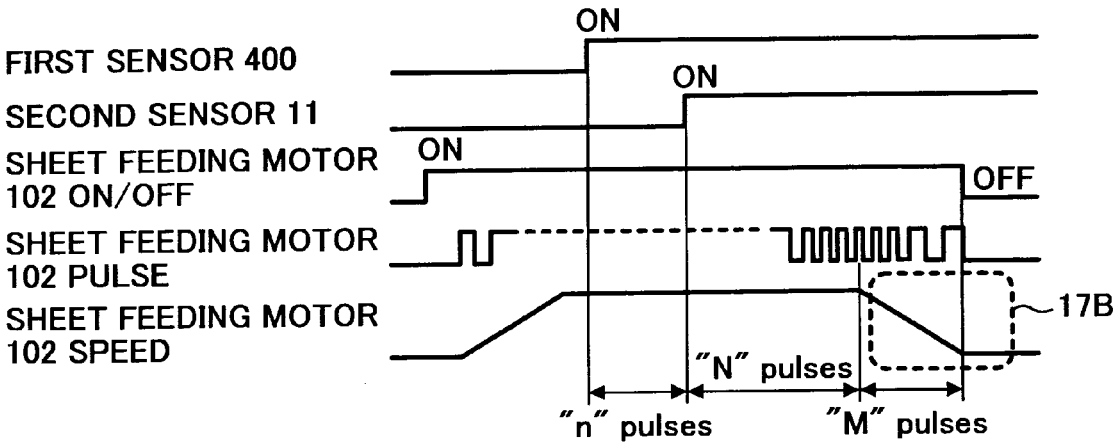
FIG. 17A is a timing chart of a sheet feeding operation when a slip of an original document does not occur or is in an allowable range in the image reading apparatus according to another embodiment of the present invention.

FIGS. 16A and 17A are timing charts of sheet feeding operation in the image reading apparatus, including the auto document feeder 300, according to another embodiment of the present invention. Specifically, FIG. 16A is a timing chart of the sheet feeding operation when an original document slips, and FIG. 17A is a timing chart of the sheet feeding operation when the slip of an original document does not occur or is in an allowable range.

In this embodiment, similar to the above-described embodiment, the controller 100 counts the pulse number "n" of the sheet feeding motor 102 during a period from when the first sensor 400 detects the leading edge of the original document to when the second sensor 11 detects the leading edge of the original document. The controller 100 determines if the original document slips by comparing the counted pulse number "n" with a predetermined pulse number. The predetermined pulse number is obtained by adding the value "α1" (e.g., several tens of pulses), considering the dispersion to the theoretical pulse number (19 mm/0.1 mm) when a slip of the original document does not occur.

When the controller 100 determines that an original document does not slip, or the slip of the original document is in an allowable range (i.e., n≦(19 mm/0.1 mm)+>1), it is considered as a normal sheet feeding, and the original document is fed and stopped such that the sheet abutment amount against the pull-out rollers 12 becomes about 2 mm. In this case, the sheet abutment amount pulse number "M" is obtained by dividing 2 mm with 0.1 mm. As described above, 0.1 mm is a sheet feeding amount per one pulse of the sheet feeding motor 102 when an original document is fed without slipping.

When the controller 100 determines that an original document slips (i.e., n>(19 mm/0.1 mm)+α1), the pulse number "N" of the sheet feeding motor 102 necessary for feeding the original document from the second sensor 11 to the nip part of the pull-out rollers 12 is obtained by the equation (1)

$$N=(n/(19\text{ mm}/0.1\text{ mm}))\times(5\text{ mm}/0.1\text{ mm}) \quad (1)$$

The sheet abutment amount pulse number "M" is set by multiplying the coefficient, considering the slip ratio such that the actual sheet abutment amount becomes about 4 mm. Specifically, as shown in the equation (3), the sheet abutment amount pulse number "M" is obtained by multiplying a sheet feeding delay ratio (n/(19 mm/0.1 mm)) by a theoretical pulse number (4 mm/0.1 mm) necessary for feeding an original document by about 4 mm.

$$M=(n/(19\text{ mm}/0.1\text{ mm}))\times(4\text{ mm}/0.1\text{ mm}) \quad (3)$$

Figure 16B:
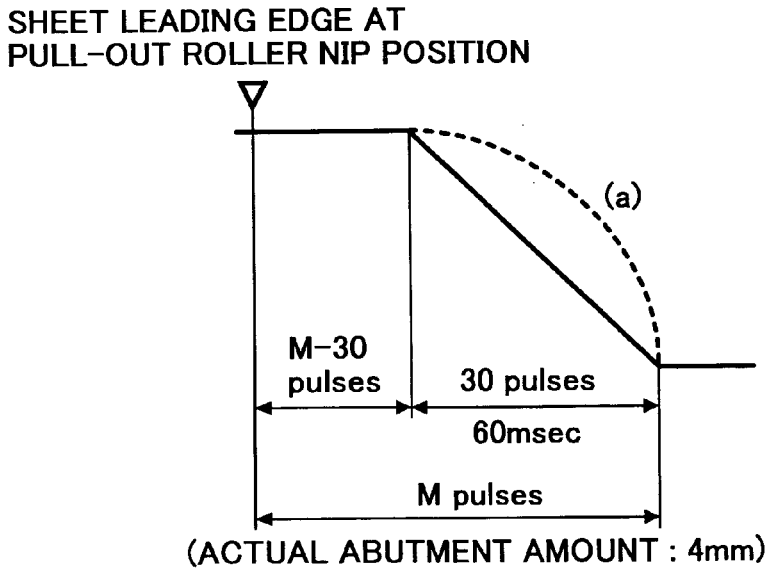
FIG. 16B is an enlarged view of a part of the timing chart of FIG. 16A.

FIG. 16B is an enlarged view of a part of the timing chart of FIG. 16A. Referring to FIG. 16B, when the slip of the original document occurs, after the leading edge of the original document abuts against the nip part of the pull-out rollers 12, the original document is fed by the sheet abutment amount pulse number "M", set as above, corresponding to the actual sheet abutment amount of about 4 mm. Specifically, after the leading edge of the original document abuts against the nip part of the pull-out rollers 12, the original document is fed at a constant speed by "M−30 pulses". Subsequently, the feeding speed of the original document is linearly decelerated by 30 pulses of the sheet feeding motor 102 (i.e., for about 60 milliseconds), as illustrated in FIG. 16B. The feeding speed of the original document may also be exponentially decelerated, as illustrated by the dotted lines (a) in FIG. 16B.

Figure 17B:
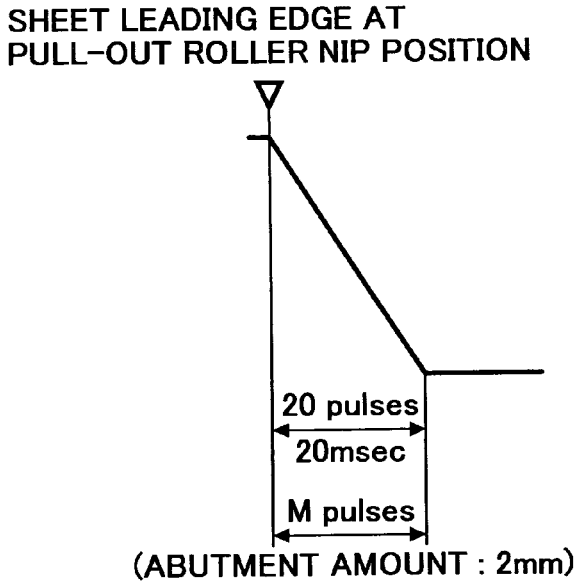
FIG. 17B is an enlarged view of a part of the timing chart of FIG. 17A.

FIG. 17B is an enlarged view of a part of the timing chart of FIG. 17A. Referring to FIG. 17B, when the slip of the original document does not occur or is in an allowable range, after the leading edge of the original document abuts against the nip part of the pull-out rollers 12, the feeding speed of the original document is linearly decelerated by 20 pulses of the sheet feeding motor 102 (i.e., for about 20 milliseconds). The distance between the second sensor 11 and the pull-out rollers 12 is set such that the sheet feeding motor 102 can be decelerated to a stop.

In the above-described sheet feeding apparatus or sheet conveying apparatus, according to the embodiment of the present invention, after the leading edge of an original document abuts against the nip part of the pull-out rollers 12, the feeding speed of an original document that has slipped is decelerated less than that of an original document that has not slipped. In the gradually decelerated sheet feeding speed period, the skew of the original document can be adequately corrected.

Figure 18A:
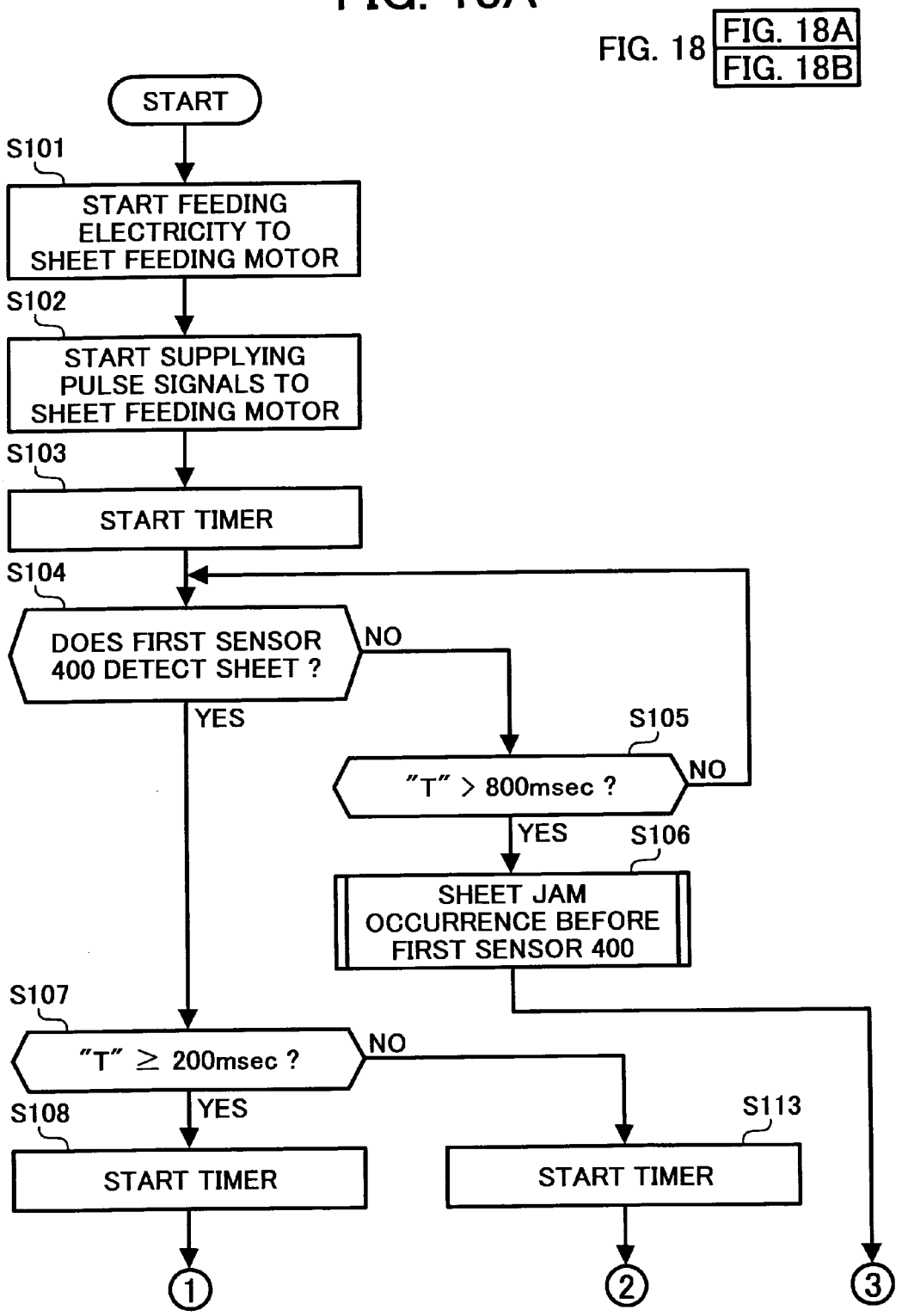
FIGS. 18A and 18B are flowcharts of sheet feeding control operation steps of a controller according to another embodiment of the present invention.
Figure 18B:
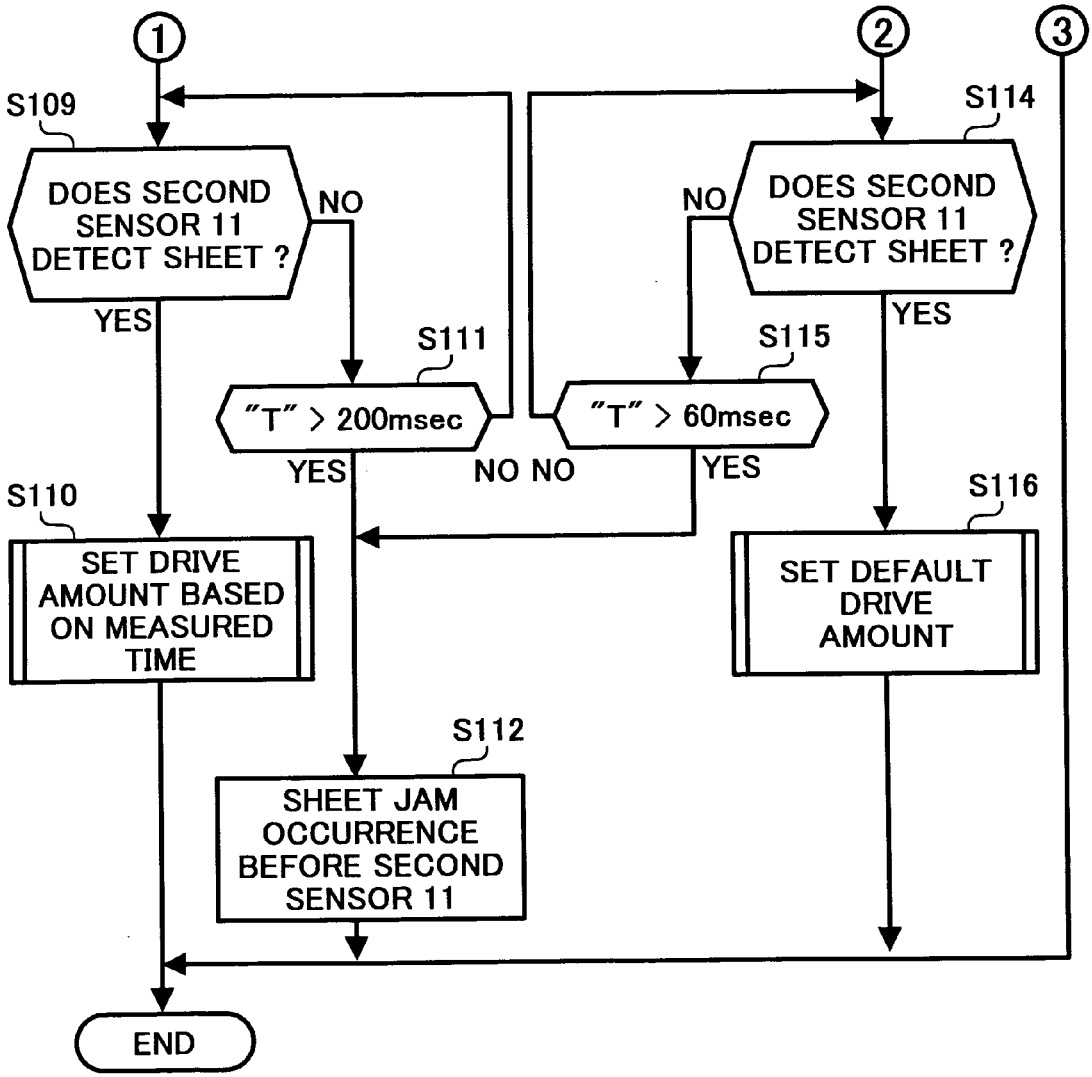

FIGS. 18A and 18B are flowcharts of sheet feeding control operation steps of the controller 100, according to another embodiment of the present invention. In this embodiment, the controller 100 changes reference values for detecting an occurrence of sheet jam between a slipped original document and a normal original document that has not slipped significantly.

Hereafter, reasons for changing reference values for detecting an occurrence of sheet jam between a slipped original document an a normal original document will be described. In the sheet feeding apparatus or the sheet conveying apparatus, in which an original document having a tendency to slip and a normal original document are fed, when setting a reference value for detecting an occurrence of sheet jam in view of a normal original document, the original document having a tendency to slip always satisfies the reference value. In this case, even though sheet jam does not occur, a sheet feeding motor is stopped, thereby causing the sheet feeding apparatus or sheet conveying apparatus to be in a halt condition. On the other hand, when setting a reference value for detecting a sheet jam for an original document having a tendency to slip, sheet jam cannot be detected for a normal original document. In this case, the original document may be damaged. For these reasons, the controller 100 changes reference values for detecting an occurrence of sheet jam between a slipped original document and a normal original document.

Referring to FIGS. 18A and 18B, the sheet feeding control operation of the controller 100 will be described. First, the controller 100 starts to feed electricity to the sheet feeding motor 102 in step S101, and starts to supply pulse signals to the sheet feeding motor 102 in step S102. Subsequently, the controller 100 starts a timer (not shown) in step S103. Then, the controller 100 determines if the first sensor 400 detects a leading edge of a sheet (i.e., an original document) in step S104. If the answer is NO in step S104, the controller 100 determines if a time "T" of the timer, measured from the start of a sheet feeding operation, exceeds 800 milliseconds in step S105. If the answer is NO in step S105, the sheet feeding control operation returns to reexecute step S104. If the answer is YES in step S105, the controller 100 determines that a sheet jam has occurred before the first sensor 400 and stops the sheet feeding motor 102 in step S106.

If the answer is YES in step S104, the controller 100 determines if the time "T" of the timer, measured from the start of sheet feeding operation, is greater than or equal to 200 milliseconds in step S107. If the answer is NO in step S107, the controller 100 determines that the sheet, which arrives the first sensor 400 in less than 200 milliseconds, has not slipped or has not slipped significantly. Then, the controller 100 resets and starts the timer again in step S113. Subsequently, the controller 100 determines if the second sensor 11 detects the leading edge of the sheet in step S114. If the answer is NO in step S114, the controller 100 determines if a measured time "T" of the timer exceeds 60 milliseconds in step S115. If the answer is NO in step S115, the sheet feeding control operation returns to reexecute step S114. If the answer is YES in step S115, the controller 100 determines that a sheet jam has occurred before the second sensor 11 and stops the sheet feeding motor 102 in step S112. If the second sensor 11 detects the leading edge of the sheet within 60 milliseconds (YES in step S114), the controller 100 sets a predetermined default drive amount (i.e., a sheet feeding amount) of the sheet feeding motor 102 for an interval between the second sensor 11 and the nip part of the pull-out rollers 12 in step S116.

If the answer is YES in step S107, the controller 100 determines that the sheet, which arrives the first sensor 400 in 200 milliseconds or greater, has slipped. Then, the controller 100 resets and starts the timer again in step S108. Subsequently, the controller 100 determines if the second sensor 11 detects the leading edge of the sheet in step S109. If the answer is NO in step S109, the controller 100 determines if a measured time "T" of the timer exceeds 200 milliseconds in step S111. If the answer is NO in step S111, the sheet feeding control operation returns to reexecute step S109. If the answer is YES in step S111, the controller 100 determines that a sheet jam occurs before the second sensor 11 and stops the sheet feeding motor 102 in step S112. If the second sensor 11 detects the leading edge of the sheet within 200 milliseconds (YES in step S109), the controller 100 sets a drive amount (i.e., a sheet feeding amount) of the sheet feeding motor 102 for an interval between the second sensor 11 and the nip part of the pull-out rollers 12 based on the measured time of the timer in step S110.

In the above-described sheet feeding apparatus or sheet conveying apparatus according to the embodiment of the present invention, the controller 100 distinguishes between a slipped original document and a normal original document based on the sheet arrival time to the first sensor 400. Further, the controller 100 changes reference values (time) for detecting an occurrence of sheet jam between the slipped original document and the normal original document. Thus, the sheet jam can be adequately detected according to the types of the original document.

Figure 19A:
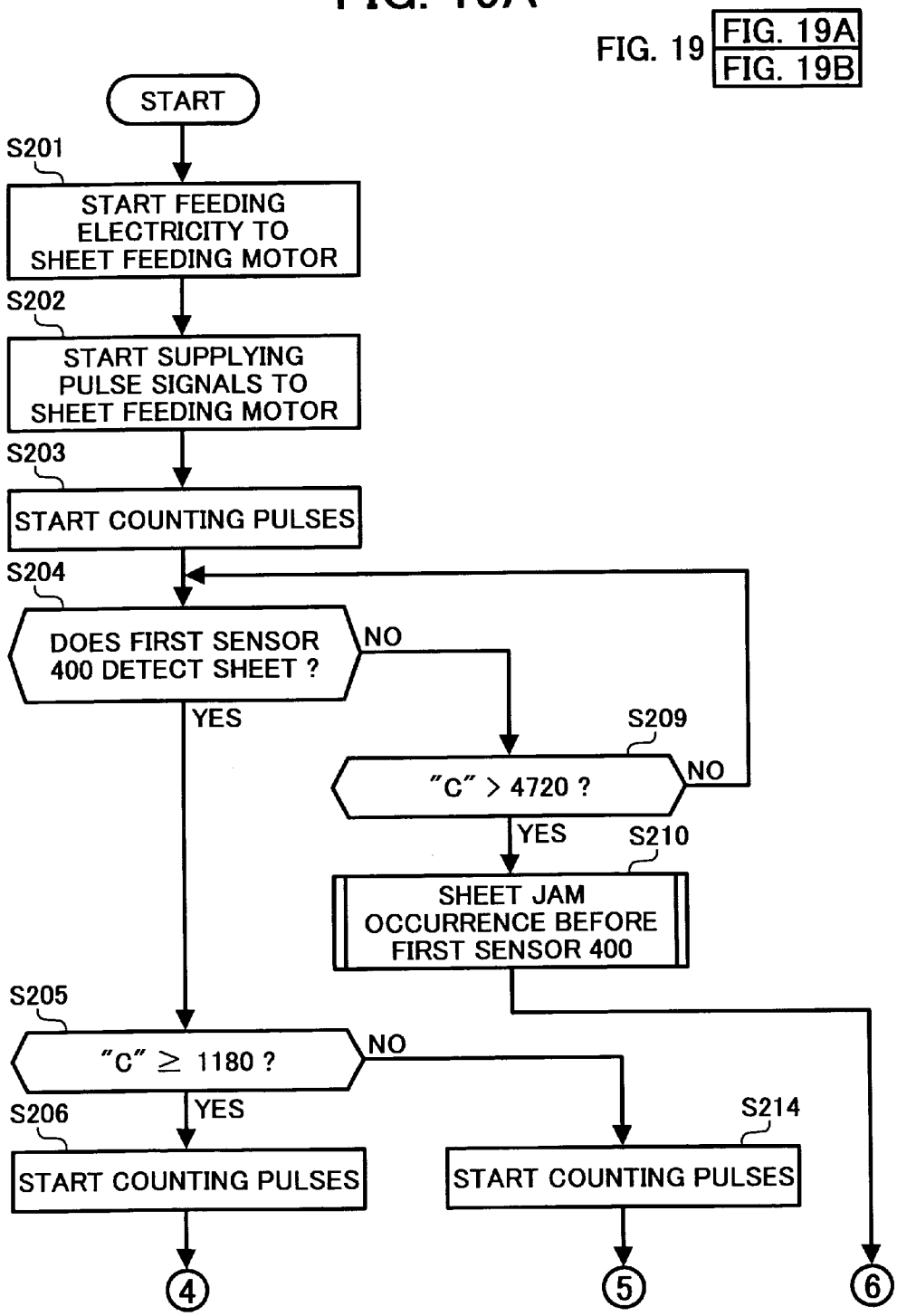
FIGS. 19A and 19B are flowcharts of sheet feeding control operation steps of a controller according to another embodiment of the present invention.
Figure 19B:
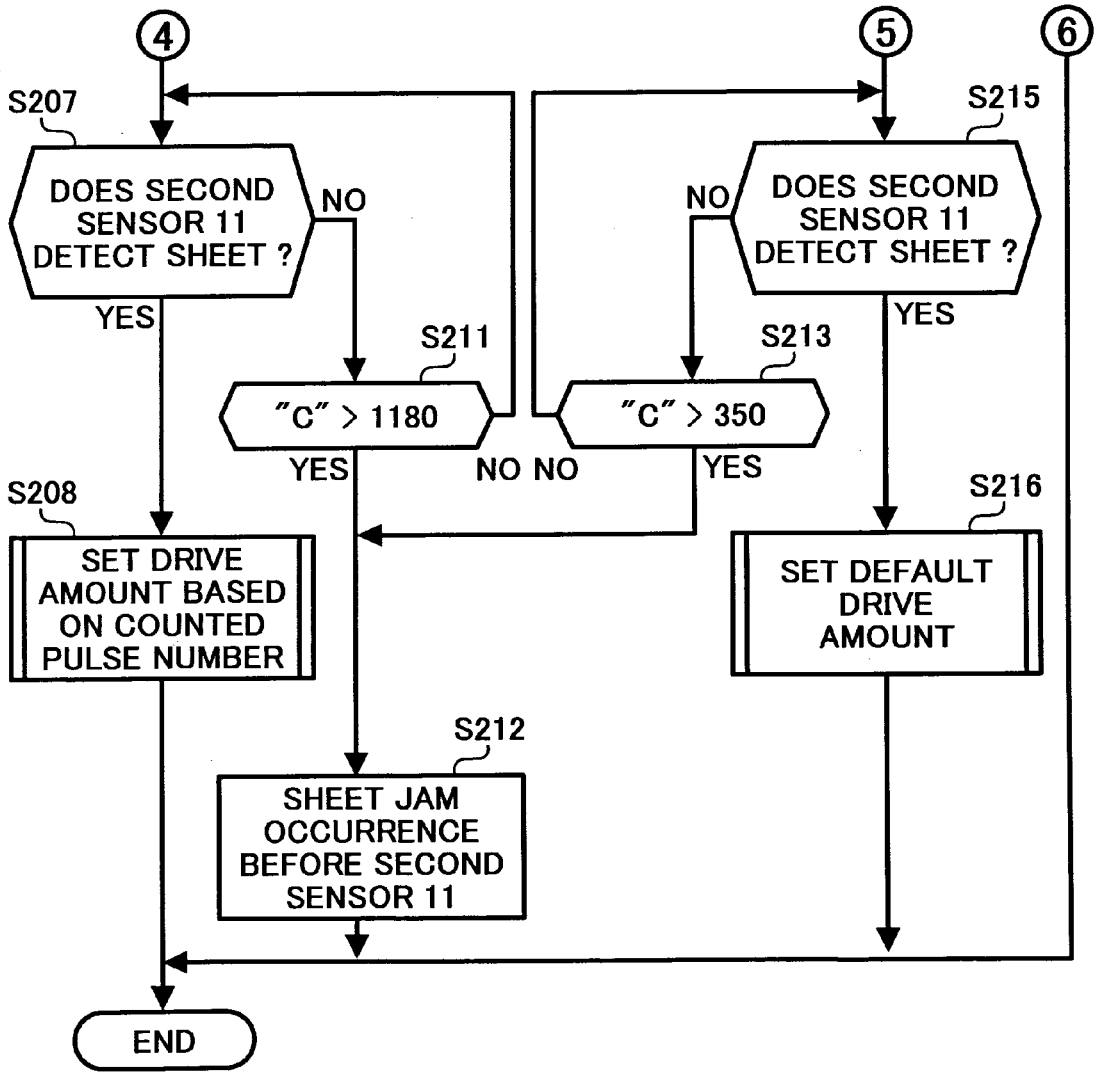

FIGS. 19A and 19B are flowcharts of sheet feeding control operation steps of the controller 100 according to another embodiment of the present invention. In this embodiment, the controller 100 detects an occurrence of sheet jam based on a counted pulse number of the sheet feeding motor 102 instead of the measured time of the timer.

Referring to FIGS. 19A and 19B, the sheet feeding control operation of the controller 100 will be described. First, the controller 100 starts to feed electricity to the sheet feeding motor 102 in step S201, and starts to supply pulse signals to the sheet feeding motor 102 in step S202. Subsequently, the controller 100 starts counting a pulse number of the sheet feeding motor 102 in step S203. Then, the controller 100 determines if the first sensor 400 detects a leading edge of a sheet (i.e., an original document) in step S204. If the answer is NO in step S204, the controller 100 determines if a pulse number "C" of the sheet feeding motor 102, counted from the start of a sheet feeding operation, exceeds 4720 pulses in step S209. If the answer is NO in step S209, the sheet feeding control operation returns to reexecute step S204. If the answer is YES in step S209, the controller 100 determines that a sheet jam occurs before the first sensor 400 and stops the sheet feeding motor 102 in step S210.

If the answer is YES in step S204, the controller 100 determines if the pulse number "C" of the sheet feeding motor 102, counted from the start of sheet feeding operation, is greater than or equal to 1180 pulses in step S205. If the answer is NO in step S205, the controller 100 determines that the sheet, which arrives the first sensor 400 in less than 1180 pulses, has not slipped or has not slipped significantly. Then, the controller 100 resets and starts counting pulse number of the sheet feeding motor 102 again in step S214. Subsequently, the controller 100 determines if the second sensor 11 detects the leading edge of the sheet in step S215. If the answer is NO in step S215, the controller 100 determines if a counted pulse number "C" of the sheet feeding motor 102 exceeds 350 in step S213. If the answer is NO in step S213, the sheet feeding control operation returns to reexecute step S215. If the answer is YES in step S213, the controller 100 determines that a sheet jam occurs before the second sensor 11 and stops the sheet feeding motor 102 in step S212. If the second sensor 11 detects the leading edge of the sheet within 350 pulses (YES in step S215), the controller 100 sets a predetermined default drive amount (i.e., a sheet feeding amount) of the sheet feeding motor 102 for an interval between the second sensor 11 and the nip part of the pull-out rollers 12 in step S216.

If the answer is YES in step S205, the controller 100 determines that the sheet, which arrives the first sensor 400 in 1180 pulses or greater, has slipped. Then, the controller 100 resets and starts counting pulse numbers of the sheet feeding motor 102 again in step S206. Subsequently, the controller 100 determines if the second sensor 11 detects the leading edge of the sheet in step S207. If the answer is NO in step S207, the controller 100 determines if a counted pulse number "C" of the sheet feeding motor 102 exceeds 1180 in step S211. If the answer is NO in step S211, the sheet feeding control operation returns to reexecute step S207. If the answer is YES in step S211, the controller 100 determines that a sheet jam occurs before the second sensor 11 and stops the sheet feeding motor 102 in step S212. If the second sensor 11 detects the leading edge of the sheet within 1180 pulses (YES in step S207), the controller 100 sets a drive amount (i.e., a sheet feeding amount) of the sheet feeding motor 102 for an interval between the second sensor 11 and the nip part of the pull-out rollers 12, based on the counted pulse number of the sheet feeding motor 102 in step S208.

In the above-described sheet feeding apparatus or sheet conveying apparatus, according to the embodiment of the present invention, the controller 100 distinguishes between a slipped original document and a normal original document based on the pulse number of the sheet feeding motor 102 counted until the leading edge of the sheet arrives at the first sensor 400. Further, the controller 100 changes reference values (pulse number of the sheet feeding motor 102) for detecting a sheet jam between the slipped original document and the normal original document. Therefore, even if the sheet feeding speed is changed, the above-described sheet feeding control operation can be performed without changing the reference values for detecting a sheet jam.

In the above-described embodiments, after a sheet (i.e., an original document) is fed by the sheet feeding belt 9, the drive amount of the sheet feeding motor 102 is measured by using two sensors, i.e., the first sensor 400 and the second sensor 11. Specifically, the actual sheet feeding speed between the first sensor 400 and the second sensor 11 is measured. Thereafter, the drive amount of the sheet feeding motor 102 is set based on the measured actual sheet feeding speed. Thus, the sheet can be surely fed to and abut against the nip part of the pull-out rollers 12, thereby preventing the sheet feeding failure at the pull-out rollers 12.

Instead of using two sensors, the sheet feeding operation may be adequately controlled by using three or more sensors. In this case, a sheet feeding operation can be adequately controlled according to changes of the feeding speed of an original document, based on a plurality of values of sheet feeding amounts and sheet feeding speeds measured in a plurality of intervals.

Figure 20:
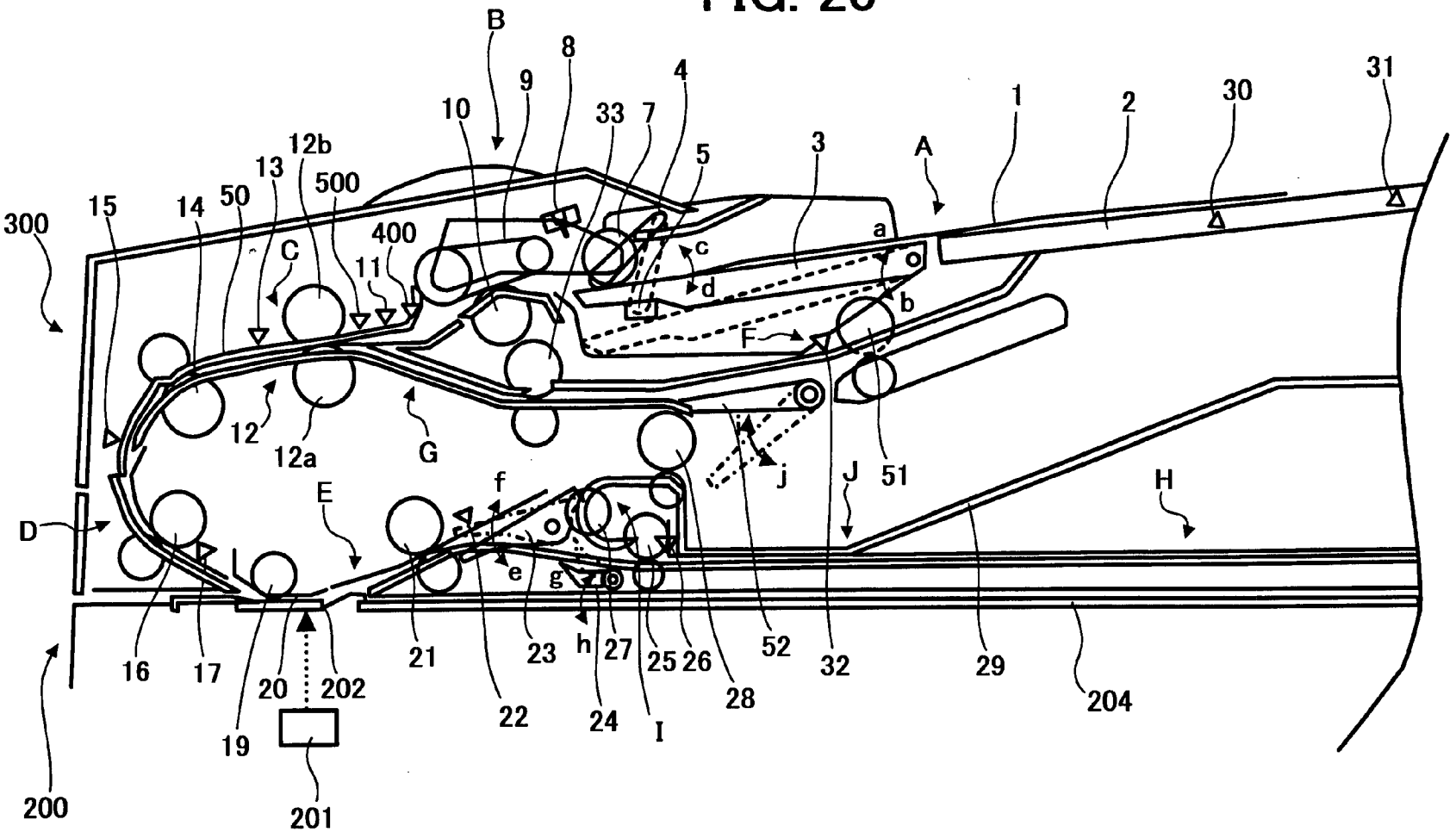
FIG. 20 is a cross section of a main construction of an image reading apparatus according to an alternative example.

For example, as illustrated in FIG. 20, the first sensor 400, the second sensor 11, and a third sensor 500 serving as a third detecting device may be provided in order in a sheet feeding path between the sheet feeding belt 9 and the pull-out rollers 12. Assuming that an interval between the first sensor 400 and the second sensor 11 is set as a first interval, and an interval between the second sensor 11 and the third sensor 500 is set as a second interval, four patterns of the change conditions of sheet feeding speed can be obtained. Specifically, a first pattern in which a sheet does not slip in both the first and second intervals, a second pattern in which a sheet slips in the first interval but does not slip in the second interval, a third pattern in which a sheet does not slip in the first interval but slips in the second interval, and a fourth pattern in which a sheet slips in both the first and second intervals. The sheet feeding operation can be finely controlled by setting the drive amount of the sheet feeding motor 102, such that the feeding amount of an original document increases in the order of the second, third, and fourth patterns. Specifically, three types of coefficients, which consider the increase of sheet slips at the downstream side of the third sensor 500 in the sheet feeding direction, are prepared. When setting a drive amount (i.e., a sheet feeding amount) of the sheet feeding motor 102 for an interval between the third sensor 500 and the nip part of the pull-out rollers 12, any one of the three types of coefficients may be used. For example, the sum of the above-described "N" pulses and "M" pulses may be multiplied by any one of the three types of coefficients. It is preferable that the above-described first through third intervals be short, so as not be affected by a sheet feeding speed variation caused by uneven application of oil to the surface of an original document.

As an alternative, an interval between the sheet pick-up roller 7 and the first sensor 400 may be set as a first interval, and an interval between the first sensor 400 and the second sensor 11 may be set as a second interval. In this case, the drive amount of the sheet feeding motor 102 in the first interval may be calculated by using a lapse of time, or by using pulse numbers of the sheet feeding motor 102, counted from when the sheet pick-up roller 7 picks up an original document to when the first sensor 400 detects the leading edge of the fed original document.

Numerous additional modifications and variations of the present invention are possible in light of the above teachings. It is therefore understood that within the scope of the appended claims, the present invention may be practiced other than as specifically described herein.

What is claimed is:

1. A sheet feeding apparatus, comprising:

a sheet feeding device configured to pick up sheets from stacked sheets and to feed the sheets one by one;

a drive device configured to drive the sheet feeding device;

a first detecting device configured to detect a sheet fed by the sheet feeding device to a first detection position located downstream of the sheet feeding device in a sheet feeding direction;

a second detecting device configured to detect the sheet fed by the sheet feeding device to a second detection position located downstream of the first detecting device in the sheet feeding direction; and a control device configured to control sheet feeding while setting a drive amount of the drive device, wherein the control device calculates a first drive amount of the drive device during a first interval from when the first detecting device detects the sheet to when the second detecting device detects the sheet based on information detected by the first and second detecting devices, wherein the control device determines if the sheet slips in the first interval based on the calculated first drive amount of the drive device, and sets a second drive amount of the drive device after the second detecting device detects the sheet during a second interval from when the second detecting device detects the sheet to when the drive device is stopped based on the calculated first drive amount;

wherein the control device determines if the sheet slipped based on a lapse of time from when the drive device is driven to when the first detecting device detects the sheet.

2. The sheet feeding apparatus according to claim 1, wherein each of the first and second drive amounts of the drive device is either a rotation number or a rotation time.

3. A sheet conveying apparatus, comprising:

a sheet feeding device configured to pick up sheets from stacked sheets and to feed the sheets one by one;

a drive device configured to drive the sheet feeding device;

a sheet conveying device configured to convey a sheet fed by the sheet feeding device to a predetermined position;

a first detecting device provided between the sheet feeding device and the sheet conveying device to detect the sheet fed by the sheet feeding device;

a second detecting device provided downstream of the first detecting device in a sheet feeding direction between the sheet feeding device and the sheet conveying device to detect the sheet fed by the sheet feeding device; and a control device configured to control sheet feeding while setting a drive amount of the drive device, wherein the control device calculates a first drive amount of the drive device during a first interval from when the first detecting device detects the sheet to when the second detecting device detects the sheet based on information detected by the first and second detecting devices, and wherein the control device determines if the sheet slips in the first interval based on the calculated first drive amount of the drive device, and sets a second drive amount of the drive device during a second interval from when the second detecting device detects the sheet to when the drive device is stopped based on the calculated first drive amount.

4. The sheet conveying apparatus according to claim 3, wherein the control device sets the second drive amount of the drive device such that the second drive amount is greater than a drive amount of the drive device that drives the sheet feeding device to feed the sheet from the second detecting device to the sheet conveying device.

5. The sheet conveying apparatus according to claim 4, wherein when the control device determines that the sheet slips in the first interval, the control device sets the second drive amount of the drive device while considering a possibility of a slip of the sheet between the second detecting device and the sheet conveying device.

6. The sheet conveying apparatus according to claim 5, wherein the control device causes the second drive amount of the drive device to gradually decrease during the second interval such that the sheet abuts against the sheet conveying device while a sheet feeding speed gradually decreases.

7. The sheet conveying apparatus according to claim 3, wherein the second detecting device is provided adjacent to the sheet conveying device.

8. The sheet conveying apparatus according to claim 3, wherein the first and second detecting devices are arranged substantially in line in the sheet feeding direction.

9. The sheet conveying apparatus according to claim 3, wherein the control device determines if the sheet reaches the second detecting device while comparing the calculated first drive amount with a predetermined value and detects a sheet jam based on a comparison result, wherein the control device calculates a third drive amount of the drive device during a third interval from when the sheet feeding device starts feeding the sheet to when the first detecting device detects the sheet, and wherein the control device determines if the sheet has slipped in the third interval while comparing the calculated third drive amount with a predetermined value, and changes reference values for detecting a sheet jam between a slipped sheet and a sheet that has not slipped.

10. The sheet conveying apparatus according to claim 3, wherein the control device determines if the sheet slipped based on a lapse of time from when the drive device is driven to when the first detecting device detects the sheet.

11. The sheet conveying apparatus according to claim 3, wherein each of the first and second drive amounts of the drive device is either a rotation number or a rotation time.

12. An image reading apparatus, comprising:

a sheet feeding device configured to pick up original documents from stacked original documents and to feed the original documents one by one;

an image reading device configured to read an image of an original document at an image reading position;

a sheet conveying device configured to convey the original document fed by the sheet feeding device to the image reading position;

a drive device configured to drive the sheet feeding device;

a first detecting device provided between the sheet feeding device and the sheet conveying device to detect the original document fed by the sheet feeding device;

a second detecting device provided downstream of the first detecting device in an original document feeding direction between the sheet feeding device and the sheet conveying device to detect the original document fed by the sheet feeding device; and a control device configured to control original document feeding while setting a drive amount of the drive device, wherein the control device calculates a first drive amount of the drive device during a first interval from when the first detecting device detects the original document to when the second detecting device detects the original document based on information detected by the first and second detecting devices, and wherein the control device determines if the original document slips in the first interval based on the calculated first drive amount of the drive device, and sets a second drive amount of the drive device during a second interval from when the second detecting device detects the original document to when the drive device is stopped based on the calculated first drive amount.

13. The, image reading apparatus according to claim 12, wherein the control device sets the second drive amount of the drive device such that the second drive amount is greater than a drive amount of the drive device that drives the sheet feeding device to feed the original document from the second detecting device to the sheet conveying device.

14. The image reading apparatus according to claim 13, wherein when the control device determines that the original document slips in the first interval, the control device sets the second drive amount of the drive device while considering a possibility of a slip of the original document between the second detecting device and the sheet conveying device.

15. The image reading apparatus according to claim 14, wherein the control device causes the second drive amount of the drive device to gradually decrease during the second interval such that the original document abuts against the sheet conveying device while a sheet feeding speed gradually decreases.

16. The image reading apparatus according to claim 12, wherein the second detecting device is provided adjacent to the sheet conveying device.

17. The image reading apparatus according to claim 12, wherein the first and second detecting devices are arranged substantially in line in the original document feeding direction.

18. The image reading apparatus according to claim 12, wherein the control device determines if the original document reaches the second detecting device while comparing the calculated first drive amount with a predetermined value and detects a sheet jam based on a comparison result, wherein the control device calculates a third drive amount of the drive device during a third interval from when the sheet feeding device starts feeding the original document to when the first detecting device detects the original document, and wherein the control device determines if the original document has slipped in the third interval while comparing the calculated third drive amount with a predetermined value, and changes reference values for detecting a sheet jam between a slipped original document and an original document that has not slipped.

19. The image reading apparatus according to claim 12, wherein the control device determines if the original document slipped based on a lapse of time from when the drive device is driven to when the first detecting device detects the original document.

20. The image reading apparatus according to claim 12, wherein each of the first and second drive amounts of the drive device is either a rotation number or a rotation time.

21. A sheet feeding apparatus, comprising:

sheet feeding means for picking up sheets from stacked sheets and for feeding the sheets one by one;

drive means for driving the sheet feeding means;

first detecting means for detecting a sheet fed by the sheet feeding means to a first detection position located downstream of the sheet feeding means in a sheet feeding direction;

second detecting means for detecting the sheet fed by the sheet feeding means to a second detection position located downstream of the first detecting means in the sheet feeding direction; and control means for controlling sheet feeding while setting a drive amount of the drive means, wherein the control means calculates a first drive amount of the drive means during a first interval from when the first detecting means detects the sheet to when the second detecting means detects the sheet based on information detected by the first and second detecting means, wherein the control means determines if the sheet slips in the first interval based on the calculated first drive amount of the drive means, and sets a second drive amount of the drive means during a second interval from when the second detecting means detects the sheet to when the drive means is stopped based on the calculated first drive amount, wherein the control means determines if the sheet slipped based on a lapse of time from when the drive means is driven to when the first detecting means detects the sheet.

22. A sheet conveying apparatus, comprising:

sheet feeding means for picking up sheets from stacked sheets and for feeding the sheets one by one;

drive means for driving the sheet feeding means;

sheet conveying means for conveying a sheet fed by the sheet feeding means to a predetermined position;

first detecting means provided between the sheet feeding means and the sheet conveying means to detect the sheet fed by the sheet feeding means;

second detecting means provided downstream of the first detecting means in a sheet feeding direction between the sheet feeding means and the sheet conveying means to detect the sheet fed by the sheet feeding means; and control means for controlling sheet feeding while setting a drive amount of the drive means, wherein the control means calculates a first drive amount of the drive means during a first interval from when the first detecting means detects the sheet to when the second detecting means detects the sheet based on information detected by the first and second detecting means, and wherein the control means determines if the sheet slips in the first interval based on the calculated first drive amount of the drive means, and sets a second drive amount of the drive means during a second interval from when the second detecting means detects the sheet to when the drive means is stopped based on the calculated first drive amount.

23. An image reading apparatus, comprising:

sheet feeding means for picking up original documents from stacked original documents and for feeding the original documents one by one;

image reading means for reading an image of an original document at an image reading position;

sheet conveying means for conveying the original document fed by the sheet feeding means to the image reading position;

drive means for driving the sheet feeding means;

first detecting means for detecting the original document fed by the sheet feeding means, the first detecting means being provided between the sheet feeding means and the sheet conveying means;

second detecting means for detecting the original document fed by the sheet feeding means, the second detecting means being provided downstream of the first detecting means in an original document feeding direction between the sheet feeding means and the sheet conveying means; and control means for controlling original document feeding while setting a drive amount of the drive means, wherein the control means calculates a first drive amount of the drive means during a first interval from when the first detecting means detects the original document to when the second detecting means detects the original document based on information detected by the first and second detecting means, and wherein the control means determines if the original document slips in the first interval based on the calculated first drive amount of the drive means, and sets a second drive amount of the drive means during a second interval from when the second detecting means detects the original document and to when the drive means is stopped based on the calculated first drive amount.

* * * * *